US011555422B2

(12) United States Patent
Vance et al.

(10) Patent No.: US 11,555,422 B2
(45) Date of Patent: Jan. 17, 2023

(54) SWITCHING ROCKER ARM HAVING CANTILEVERED ROLLERS

(71) Applicant: EATON INTELLIGENT POWER LIMITED, Dublin (IE)

(72) Inventors: Matthew Vance, Kalamazoo, MI (US); Guruprasath Alagarsamy, Tamil Nadu (IN); James E. McCarthy, Jr., Kalamazoo, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 15/889,144

(22) Filed: Feb. 5, 2018

(65) Prior Publication Data

US 2018/0320603 A1 Nov. 8, 2018

Related U.S. Application Data

(63) Continuation of application No. PCT/US2016/045842, filed on Aug. 5, 2016.
(Continued)

(30) Foreign Application Priority Data

Oct. 16, 2015 (IN) ..... IN3342/DEL/2015

(51) Int. Cl.
*F01L 1/18* (2006.01)
*F01L 13/00* (2006.01)
(Continued)

(52) U.S. Cl.
CPC ..... *F01L 1/185* (2013.01); *F01L 13/0021* (2013.01); *F01L 13/0031* (2013.01);
(Continued)

(58) Field of Classification Search
CPC .. F02D 13/0242; F02D 13/0257; F02D 13/06; F01L 13/0005; F01L 13/0031;
(Continued)

(56) References Cited

U.S. PATENT DOCUMENTS 5,148,783 A 9/1992 Shinkai et al.
5,544,626 A 8/1996 Diggs et al.
(Continued)

FOREIGN PATENT DOCUMENTS

CN 104321503 B 3/2017
DE 10310219 A1 9/2004
(Continued)

OTHER PUBLICATIONS

International Search Report and Written Opinion for PCT/US2016/045842 dated Oct. 28, 2016; pp. 1-23.
(Continued)

*Primary Examiner* — Jorge L Leon, Jr.
(74) *Attorney, Agent, or Firm* — Baker Botts L.L.P.

(57) ABSTRACT

A switching rocker arm comprises an outer arm having a pair of integrally formed axles extending outwardly therefrom and an inner arm pivotally secured to the outer arm. A is latch slidably connected to the outer arm and is configured to selectively extend to engage the inner arm. An inner roller is configured on the inner arm, and a pair of outer rollers is mounted on the respective integrally formed axles on the outer arm. A rocker arm for variable valve lift comprises an outer arm comprising outer arm portions, rollers mounted in a cantilevered manner to the outer arm portions, and an inner arm seated between the outer arm portions, the inner arm comprising an inner roller. A pivot axle connects the outer arm and the inner arm. The inner arm and the outer arm are pivotable with respect to one another about the pivot axle.

16 Claims, 12 Drawing Sheets

Related U.S. Application Data

(60) Provisional application No. 62/203,879, filed on Aug. 11, 2015, provisional application No. 62/203,374, filed on Aug. 10, 2015, provisional application No. 62/201,555, filed on Aug. 5, 2015.

(51) Int. Cl.

| | |
|---|---|
| ***F02D 13/02*** | (2006.01) |
| ***F02D 13/06*** | (2006.01) |
| *F01L 1/46* | (2006.01) |
| *F01L 1/24* | (2006.01) |
| *F01L 13/06* | (2006.01) |

(52) U.S. Cl.
CPC ..... *F02D 13/0242* (2013.01); *F02D 13/0257* (2013.01); *F02D 13/06* (2013.01); *F01L 1/2405* (2013.01); *F01L 13/0005* (2013.01); *F01L 13/06* (2013.01); *F01L 2001/186* (2013.01); *F01L 2001/467* (2013.01); *F01L 2013/001* (2013.01); *F01L 2305/02* (2020.05)

(58) Field of Classification Search
CPC ... F01L 13/0021; F01L 13/06; F01L 13/0036; F01L 1/185; F01L 2001/186; F01L 2001/467; F01L 2105/00; F01L 2013/001; F01L 1/2405; F01L 2305/02
USPC ..... 123/90.41, 90.43, 90.44
See application file for complete search history.

(56) References Cited

U.S. PATENT DOCUMENTS 6,314,928 B1 11/2001 Baraszu et al.
6,325,030 B1 12/2001 Spath et al.
6,439,179 B2 8/2002 Hendriksma et al.
6,481,400 B2 11/2002 Hendriksma et al.
6,502,536 B2 1/2003 Lee et al.
6,532,920 B1 * 3/2003 Sweetnam ..... F01L 13/0015 123/90.46
6,604,498 B2 8/2003 Fernandez et al.
6,901,894 B2 6/2005 Haas et al.
6,948,466 B2 9/2005 Haas et al.
7,318,402 B2 1/2008 Harman et al.
7,377,247 B2 5/2008 Seitz
7,484,487 B2 2/2009 Zurface et al.
7,712,443 B2 5/2010 Gemein
7,798,112 B2 9/2010 Zurface et al.
7,798,113 B2 9/2010 Fischer et al.
7,882,814 B2 2/2011 Spath et al.
8,215,275 B2 7/2012 Church
8,251,032 B2 8/2012 Manther
8,327,750 B2 12/2012 Keller et al.
8,534,182 B2 9/2013 Keller et al.
8,607,753 B2 12/2013 Krause et al.
8,635,980 B2 1/2014 Church
8,726,862 B2 5/2014 Zurface et al.
8,752,513 B2 6/2014 Zurface et al.
8,783,219 B2 7/2014 Gunnel et al.
8,915,225 B2 12/2014 Zurface et al.
8,985,074 B2 3/2015 Zurface et al.
9,016,252 B2 4/2015 Zurface et al.
9,038,586 B2 5/2015 Schultheis et al.
9,140,148 B2 9/2015 Church
9,194,260 B2 11/2015 Zurface
9,194,261 B2 11/2015 McCarthy, Jr.
9,228,454 B2 1/2016 VanDeusen
9,267,396 B2 2/2016 Zurface et al.
9,284,859 B2 3/2016 Nielsen et al.
9,291,075 B2 3/2016 Zurface et al.
9,470,116 B2 10/2016 Cecur
9,581,058 B2 2/2017 Radulescu et al.
9,644,503 B2 5/2017 Zurface et al.
9,664,075 B2 5/2017 McCarthy, Jr.
D791,190 S 7/2017 McCarthy, Jr. et al.
9,702,279 B2 7/2017 Zurface et al.
9,708,942 B2 7/2017 Zurface et al.
9,726,052 B2 8/2017 Zurface et al.
9,765,657 B2 9/2017 VanDeusen
9,790,823 B2 10/2017 Zurface
10,253,657 B2 4/2019 Uckermark et al.
2001/0023675 A1 * 9/2001 Lee ..... F01L 13/0036 123/90.44
2001/0027765 A1 10/2001 Hendriksma et al.
2002/0011225 A1 1/2002 Hendriksma et al.
2004/0035381 A1 * 2/2004 Burch ..... F01L 13/0015 123/90.16
2004/0103869 A1 * 6/2004 Harris ..... F01L 1/08 123/90.16
2004/0206324 A1 10/2004 Artmann
2004/0237919 A1 12/2004 Haas et al.
2005/0132989 A1 * 6/2005 Hendriksma ..... F01L 1/18 123/90.16
2005/0132990 A1 6/2005 Haas et al.
2006/0157008 A1 7/2006 Lechner et al.
2007/0101958 A1 5/2007 Seitz
2007/0113809 A1 5/2007 Harman et al.
2007/0186890 A1 8/2007 Zurface
2007/0283914 A1 12/2007 Zurface et al.
2008/0283003 A1 * 11/2008 Hendriksma ..... F01L 13/0005 123/90.6
2008/0314340 A1 * 12/2008 Fischer ..... F01L 13/0015 123/90.2
2009/0217895 A1 9/2009 Spath et al.
2010/0018482 A1 1/2010 Keller et al.
2010/0043737 A1 * 2/2010 Elnick ..... F01L 1/18 123/90.39
2010/0319657 A1 12/2010 Dodi et al.
2011/0139099 A1 * 6/2011 Roe ..... F01L 13/0005 123/90.1
2011/0226208 A1 9/2011 Zurface et al.
2011/0226209 A1 9/2011 Zurface et al.
2012/0037107 A1 2/2012 Church
2012/0222639 A1 * 9/2012 Knauf ..... F01L 13/0021 123/90.44
2012/0260875 A1 10/2012 Moeck et al.
2013/0000582 A1 1/2013 Church
2013/0068182 A1 3/2013 Keller et al.
2013/0146008 A1 * 6/2013 Stoody ..... F01L 1/267 123/90.39
2013/0220250 A1 8/2013 Gunnel et al.
2013/0233265 A1 9/2013 Zurface et al.
2013/0255612 A1 10/2013 Zurface et al.
2013/0306013 A1 11/2013 Zurface et al.
2013/0312506 A1 11/2013 Nielsen et al.
2013/0312681 A1 11/2013 Schultheis et al.
2013/0312686 A1 11/2013 Zurface et al.
2013/0312687 A1 11/2013 Zurface et al.
2013/0312688 A1 * 11/2013 VanDeusen ..... F01L 13/0015 123/90.39
2013/0312689 A1 11/2013 Zurface et al.
2014/0041608 A1 2/2014 Zurface
2014/0150745 A1 6/2014 Church
2014/0190431 A1 7/2014 McCarthy, Jr.
2014/0283768 A1 9/2014 Keller et al.
2015/0128890 A1 5/2015 Cecur
2015/0211394 A1 7/2015 Zurface et al.
2015/0267574 A1 9/2015 Radulescu et al.
2015/0369095 A1 12/2015 Spoor et al.
2015/0371793 A1 12/2015 Sheren et al.
2015/0377093 A1 12/2015 Church
2016/0061067 A1 3/2016 Schultheis et al.
2016/0061068 A1 3/2016 Zurface
2016/0084117 A1 3/2016 Zurface et al.
2016/0108766 A1 4/2016 Zurface et al.
2016/0115831 A1 4/2016 Spoor et al.
2016/0130991 A1 5/2016 Zurface et al.
2016/0138435 A1 5/2016 Zurface et al.
2016/0138438 A1 5/2016 Genise et al.
2016/0138484 A1 5/2016 Nielsen et al.
2016/0146064 A1 5/2016 Spoor et al.
2016/0169065 A1 6/2016 VanDeusen

(56) References Cited

U.S. PATENT DOCUMENTS

| | | | |
|---|---|---|---|
| 2016/0230619 | A1 | 8/2016 | Mccarthy, Jr. |
| 2016/0273413 | A1 | 9/2016 | Sheren et al. |
| 2017/0002698 | A1 | 1/2017 | Cecur |
| 2017/0248073 | A1 | 8/2017 | McCarthy |
| 2019/0284971 | A1 | 9/2019 | Vance et al. |
| 2019/0309659 | A1 | 10/2019 | Vance |
| 2019/0309660 | A1 | 10/2019 | Vance |
| 2020/0056512 | A1 | 2/2020 | Vance |

FOREIGN PATENT DOCUMENTS

| | | | |
|---|---|---|---|
| DE | 102010006420 | A1 | 8/2011 |
| DE | 102012220216 | A1 | 5/2014 |
| WO | 2013156610 | A1 | 10/2013 |
| WO | 2014134601 | A1 | 9/2014 |
| WO | 2014134601 | A9 | 9/2014 |
| WO | WO-2016/155978 | A1 | 10/2016 |
| WO | 2018068041 | A1 | 4/2018 |
| WO | 2018068043 | A1 | 4/2018 |
| WO | 2018068045 | A1 | 4/2018 |
| WO | 2018068046 | A1 | 4/2018 |

OTHER PUBLICATIONS

International Search Report and Written Opinion for PCT/US2017/055766; dated Jan. 22, 2018; pp. 1-21.
International Search Report and Written Opinion for PCT/US2017/055777 dated Jan. 24, 2018; pp. 1-23.
International Search Report and Written Opinion for PCT/US2017/055785 dated Jan. 17, 2018; pp. 1-18.
International Search Report and Written Opinion for PCT/US2017/055788; dated Jan. 24, 2018; pp. 1-4.

* cited by examiner

SWITCHING ROCKER ARM HAVING CANTILEVERED ROLLERS

CROSS-REFERENCE TO RELATED APPLICATIONS

This application claims the benefit of U.S. Patent Application No. 62/201,555 filed on Aug. 5, 2015, U.S. Patent Application No. 62/203,374 filed on Aug. 10, 2015, U.S. Patent Application No. 62/203,879 filed on Aug. 11, 2015, and Indian Patent Application No. 3342/DEL/2015 filed on Oct. 16, 2015. This application is a Bypass Continuation under 35 U.S.C. § 111(a) of PCT/US2016/045842 filed Aug. 5, 2016. The disclosures of the above applications are incorporated herein by reference.

FIELD

The present disclosure relates generally to switching roller finger followers or rocker arms in internal combustion engines.

BACKGROUND

Variable valve actuation (VVA) technologies have been introduced and documented. One VVA device may be a variable valve lift (VVL) system, a cylinder deactivation (CDA) system such as that described in U.S. Pat. No. 8,215,275 entitled "Single Lobe Deactivating Rocker Arm" hereby incorporated by reference in its entirety, or other valve actuation systems. Such mechanisms are developed to improve performance, fuel economy, and/or reduce emissions of the engine. Several types of the VVA rocker arm assemblies include an inner rocker arm within an outer rocker arm that are biased together with torsion springs.

Switching rocker arms allow for control of valve actuation by alternating between latched and unlatched states. A latch, when in a latched position causes both the inner and outer rocker arms to move as a single unit. When unlatched, the rocker arms are allowed to move independent of each other. In some circumstances, these arms can engage different cam lobes, such as low-lift lobes, high-lift lobes, and no-lift lobes. Mechanisms are required for switching rocker arm modes in a manner suited for operation of internal combustion engines.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A switching rocker arm constructed in accordance to one example of the present disclosure includes an outer arm, an inner arm, a latch, an inner roller and a first torsion spring. The outer arm has a pair of outer arm portions and a connecting arm extending therebetween. The connecting arm includes an outwardly extending tab. The inner arm is pivotally secured to the outer arm and has an outwardly extending protrusion. The latch is slidably connected to the inner arm and is configured to selectively extend to engage the outwardly extending tab of the outer arm. The inner roller and bearing is configured on the inner arm. The first torsion spring is disposed between the outer arm and the inner arm. The first torsion spring has a first end and a second end. The first end is engaged to the connecting arm and is restrained from outward movement by the outer arm and restrained from inward movement by the outwardly extending tab. The second end is restrained by the outwardly extending protrusion.

According to additional features, the first torsion spring includes an inner diameter that is received by a first post extending from the inner arm. A second torsion spring is disposed between the outer arm and the inner arm. The second torsion spring has a first end and a second end. The first end is engaged to the connecting arm and is restrained from outward movement by the outer arm and restrained from inward movement by the outwardly extending tab. The second end is restrained by the outwardly extending protrusion. The first and second torsion springs are lost motion torsion springs. The outer arm includes a pair of outer rollers mounted thereon. The pair of outer rollers are rotatably mounted on an outer arm roller axle.

According to other features, the bearing is a needle bearing having a hollow axle and a plurality of needles. The outer arm roller axle is positioned eccentrically relative to the hollow axle to account for lost motion. The outer arm has a pair of stopper bushings configured thereon at an interface with the outer arm roller axle.

A switching rocker arm constructed in accordance to another example of the present disclosure includes an outer arm, an inner arm, a latch, an inner roller, a first torsion spring and a second torsion spring. The outer arm has a pair of outer arm portions and a connecting arm extending therebetween. Each outer arm has a hook extending therefrom. The inner arm is pivotally secured to the outer arm and has an outwardly extending protrusion. The latch is slidably connected to the inner arm and is configured to selectively extend to engage the outwardly extending tab of the outer arm. The inner roller and bearing is configured on the inner arm. The first torsion spring is disposed between the outer arm and the inner arm. The first torsion spring has a first end and a second end. The first end is engaged to the connecting arm and is restrained from outward movement by the outer arm and restrained from inward movement by the outwardly extending tab. The second end is restrained by the outwardly extending protrusion. The second torsion spring is disposed between the outer arm and the inner arm. The second torsion spring has a first end and a second end. The first end is engaged to the connecting arm and is restrained from outward movement by the outer arm and restrained from inward movement by the outwardly extending tab. The second end is restrained by the outwardly extending protrusion.

According to additional features, the first and second torsion springs are received by respective posts extending from the inner arm. The first and second torsion springs are lost motion torsion springs. The outer arm includes a pair of outer rollers mounted thereon. The pair of outer rollers are rotatably mounted on an outer arm roller axle. The bearing is a needle bearing having a hollow axle and a plurality of needles. The outer arm roller axle is positioned eccentrically relative to the hollow axle to account for lost motion. The outer arm has a pair of stopper bushings configured thereon at an interface with the outer arm roller axle.

A switching rocker arm constructed in accordance to another example of the present disclosure includes an outer arm, an inner arm, a latch, an inner roller, a first torsion spring and a second torsion spring. The outer arm has a pair of outer arm portions and a connecting arm extending therebetween. The connecting arm has a first notch and a second notch. The inner arm is pivotally secured to the outer arm and has an outwardly extending protrusion. The latch is slidably connected to the inner arm and is configured to selectively extend to engage the outwardly extending tab of the outer arm. The inner roller and bearing is configured on the inner arm. The first torsion spring is disposed between the outer arm and the inner arm. The first torsion spring has a first end and a second end. The first end of the first torsion spring is received by the first notch. The second end is restrained by the outwardly extending protrusion. The second torsion spring is disposed between the outer arm and the inner arm. The second torsion spring has a first end and a second end. The first end of the second torsion spring is received by the second notch. The second end is restrained by the outwardly extending protrusion.

According to other features, the first notch has first notch outer walls. The second notch has second notch outer walls. The first end of the first torsion spring is restrained from inward and outward movement by the first notch outer walls. The first end of the second torsion spring is restrained from inward and outward movement by the second notch outer walls. The first and second torsion springs are received by respective posts extending from the inner arm. The first and second torsion springs are lost motion torsion springs. The outer arm includes a pair of outer rollers mounted thereon. The pair of outer rollers are rotatably mounted on an outer arm roller axle. The bearing is a needle bearing having a hollow axle and a plurality of needles.

In other features, the outer arm roller axle is positioned eccentrically relative to the hollow axle to account for lost motion. The outer arm has a pair of stopper bushings configured thereon at an interface with the outer arm roller axle. The bearing is a needle bearing having a hollow axle and a plurality of needles. The outer arm roller axle is positioned eccentrically relative to the hollow axle to account for lost motion. The outer arm has a pair of stopper bushings configured thereon at an interface with the outer arm roller axle.

A switching rocker arm constructed in accordance to another example of the present disclosure includes an outer arm, an inner arm, a latch, an inner roller, a first torsion spring and a second torsion spring. The outer arm has a pair of outer arm portions and a connecting arm extending therebetween. The outer arm portions each have a connecting pin extending inwardly therefrom. The inner arm is pivotally secured to the outer arm and has an outwardly extending protrusion. The latch is slidably connected to the inner arm and is configured to selectively extend to engage the outwardly extending tab of the outer arm. The inner roller and bearing is configured on the inner arm. The first torsion spring is disposed between the outer arm and the inner arm. The first torsion spring has a first end and a second end. The first end of the first torsion spring contacts a respective connecting pin. The second end is restrained by the outwardly extending protrusion. The second torsion spring is disposed between the outer arm and the inner arm. The second torsion spring has a first end and a second end. The first end of the second torsion spring contacts a respective connecting pin. The second end is restrained by the outwardly extending protrusion.

According to additional features, the first and second torsion springs are received by respective posts extending from the inner arm. The first and second torsion springs are lost motion torsion springs. The outer arm includes a pair of outer rollers mounted thereon. The pair of outer rollers are rotatably mounted on an outer arm roller axle. The bearing is a needle bearing having a hollow axle and a plurality of needles. In other features, the outer arm roller axle is positioned eccentrically relative to the hollow axle to account for lost motion. The outer arm has a pair of stopper bushings configured thereon at an interface with the outer arm roller axle. The bearing is a needle bearing having a hollow axle and a plurality of needles. The outer arm roller axle is positioned eccentrically relative to the hollow axle to account for lost motion. The outer arm has a pair of stopper bushings configured thereon at an interface with the outer arm roller axle.

A switching rocker arm constructed in accordance to another example incudes an outer arm, an inner arm, a latch, an inner roller and a pair of outer rollers. The outer arm has a pair of integrally formed axles extending outwardly therefrom. The inner arm is pivotally secured to the outer arm. The latch is slidably connected to the outer arm and is configured to selectively extend to engage the inner arm. The inner roller is configured on the inner arm. The pair of outer rollers are mounted on the respective integrally formed axles on the outer arm. The outer rollers are cantilevered relative to the outer arm.

A variable valve lift rocker arm comprises an outer arm comprises a pair of outer arm portions, each outer arm portion comprising a cantilevered axle extending therefrom. An inner arm comprises an inner roller, and the inner roller is seated between the outer arm portions. A pair of outer rollers are respectively mounted on the pair of outer arm portions. The rocker arm is configured to switch between the outer arm and the inner arm being fixed for concurrent rotation and the outer arm and the inner arm being rotatable relative to each other.

A rocker arm for variable valve lift comprises an outer arm comprising outer arm portions, rollers mounted in a cantilevered manner to the outer arm portions, and an inner arm seated between the outer arm portions, the inner arm comprising an inner roller. A pivot axle connects the outer arm and the inner arm. The inner arm and the outer arm are pivotable with respect to one another about the pivot axle.

BRIEF DESCRIPTION OF THE DRAWINGS

The present disclosure will become more fully understood from the detailed description and the accompanying drawings, wherein.

DETAILED DESCRIPTION

Figure 1:
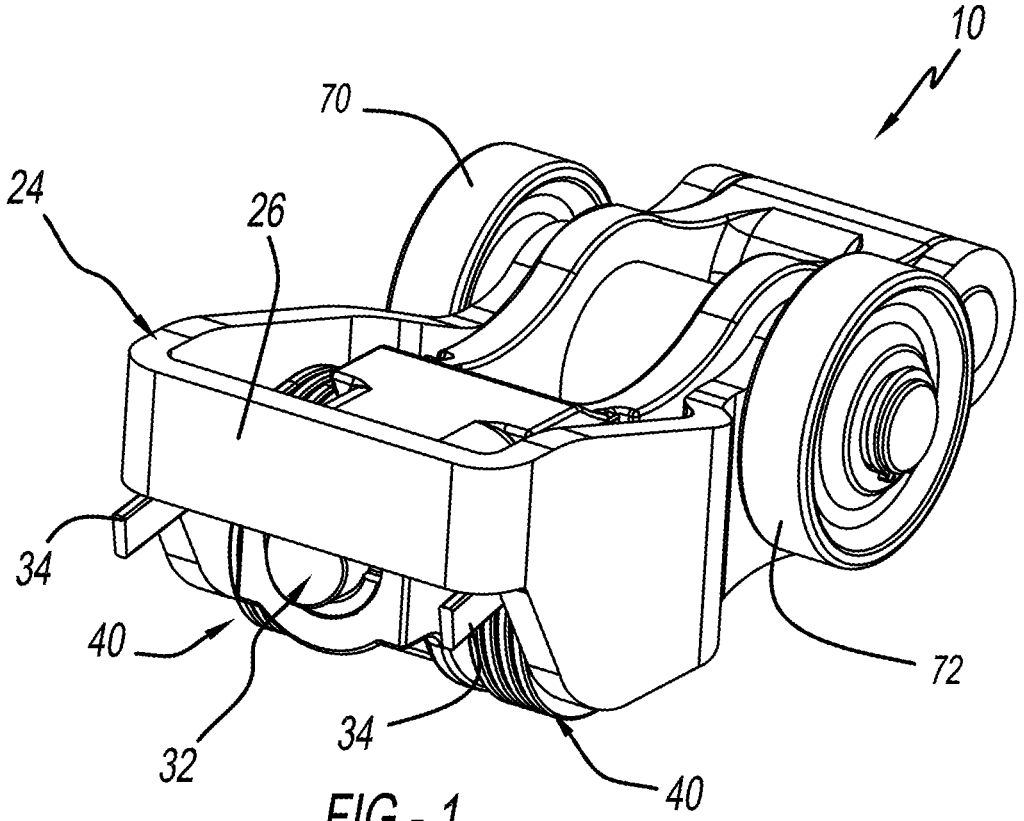
FIG. 1 is a partial perspective view of a switching rocker arm constructed in accordance to one example of the present disclosure.

With initial reference to FIGS. 1-4, an exemplary switching rocker arm assembly constructed in accordance with one example of the present disclosure is shown and generally identified at reference 10. The switching rocker arm assembly 10 can be a compact cam-driven single-lobe cylinder deactivation (CDA-1L) switching rocker arm installed on a piston-driven internal combustion engine, and actuated with the combination of a dual-feed hydraulic lash adjusters (DFHLA) and oil control valves (OCV). The switching rocker arm assembly 10 can include an inner arm 22 and an outer arm 24. The default configuration is in the normal-lift (latched) position where the inner arm 22 and the outer arm 24 are locked together, causing an engine valve to open and allowing the cylinder to operate as it would in a standard valvetrain. The DFHLA has two oil ports. A lower oil port provides lash compensation and is fed engine oil similar to a standard HLA. An upper oil port, referred as the switching pressure port, provides the conduit between controlled oil pressure from the OCV and a latch 32. Additional description of the DFHLA may be found in commonly owned International Application PCT/US2015/039344 filed Jul. 7, 2015, which is hereby incorporated by reference in its entirety. When the latch 32 is engaged, the inner arm 22 and the outer arm 24 operate together like a standard rocker arm to open the engine valve. The inner arm 22 may include a rear stopper (not shown) that is configured to engage the outer arm 24. In the no-lift (unlatched) position, the inner arm 22 and the outer arm 24 can move independently to enable cylinder deactivation. A pair of biasing mechanisms 40 such as lost motion torsion springs are incorporated to bias the position of the inner arm 22 so that it always maintains continuous contact with the camshaft lobe.

Figure 4:
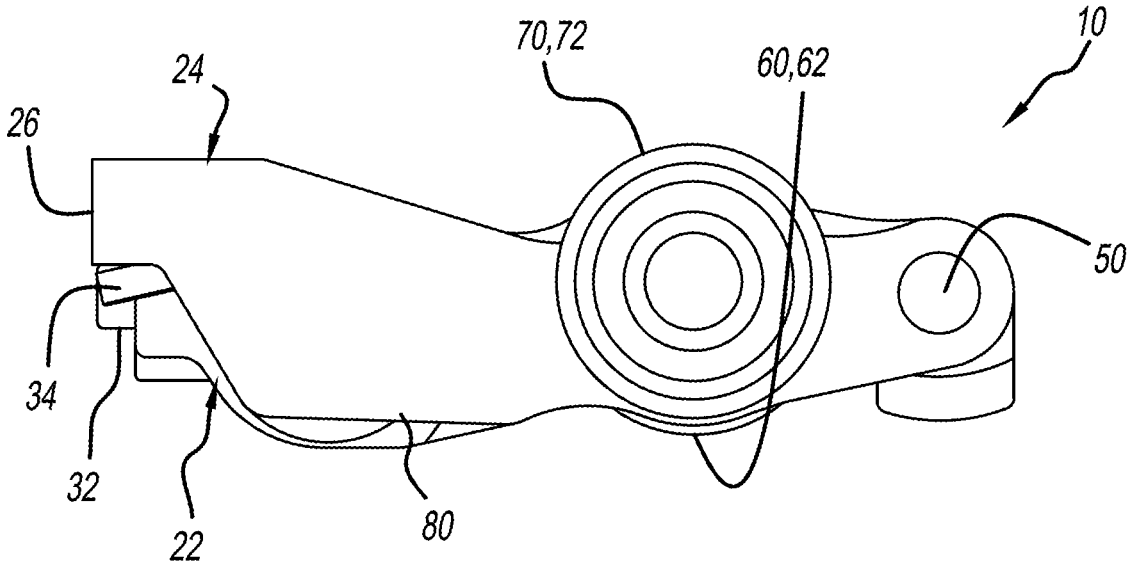
FIG. 4 is a side view of the switching rocker arm of FIG. 1.
Figure 5:
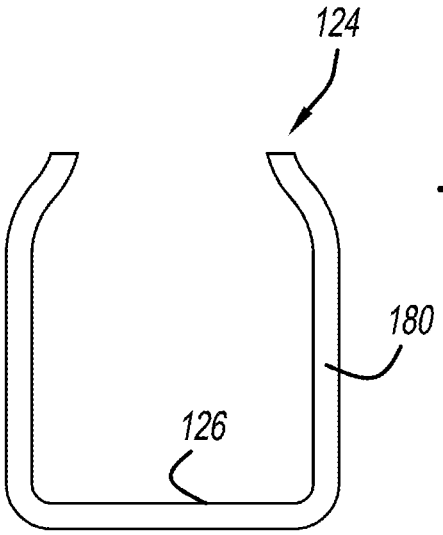
FIG. 5 is a partial top view of an outer rocker arm constructed in accordance to another example of the present disclosure.

The inner arm 22 and the outer arm 24 are both mounted to a pivot axle 50 (FIG. 4). The pivot axle 50 can be located adjacent to a first end of the rocker arm assembly 10, which secures the inner arm 22 to the outer arm 24 while also allowing a rotational degree of freedom pivoting about the pivot axle 50 when the rocker arm assembly 10 is in a deactivated state. In addition to the illustrated example having a separate pivot axle 50 mounted to the outer arm 24 and the inner arm 22, the pivot axle 50 may be integral to the outer arm 24 or to the inner arm 22. The rocker arm assembly 10 can include a bearing 60 having a roller 62 that is mounted between inner side arms that form the inner arm 22 on a bearing axle that, during normal operation of the rocker arm assembly 10 serves to transfer energy from a rotating cam to the rocker arm assembly 10. A pair of outer rollers 70, 72 are mounted on the outer rocker arm 24.

The switching rocker arm assembly 10 enables the variability in valve lift by inducing lost motion for one lift profile while transmitting the secondary lift profile to the valve or vice versa. Generally, the latching pin or connecting mechanism tightly controlled to minimize the effect of the clearance on to the valve lift. However, depending on the application and purpose of the secondary valve lift, not all designs need to be tightly controlled. In one such application, where latch clearance to the interfacing arm is not having a wider pronounced effect on the valve. A design that could achieve this configuration has optimal requirements in the manufacturing process. There are also benefits in terms of compactness, cost and better kinematic performance with further optimization of the rocker arm parameters layout.

The rocker arm assembly 10 achieves the main valve lift in the roller 60 and the secondary valve lift on the outer rollers 70, 72 due to the application duty cycle. A normally unlatched design employed to selectively use the secondary valve lift when required per the engine duty cycle. The inner arm 22 houses the bearing 60 and roller 62, while the outer arm 24 includes a connecting arm 26. The pivot axle 50 connects both the inner and outer arms 22, 24 and is placed over the top of the engine valve.

Figure 2:
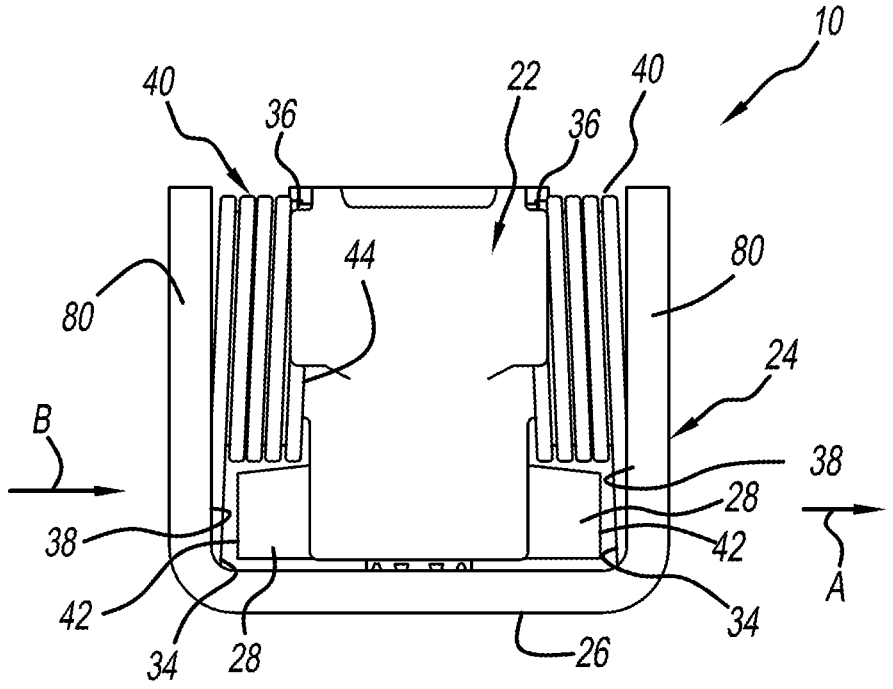
FIG. 2 is a partial top view of the switching rocker arm of FIG. 1.
Figure 3:
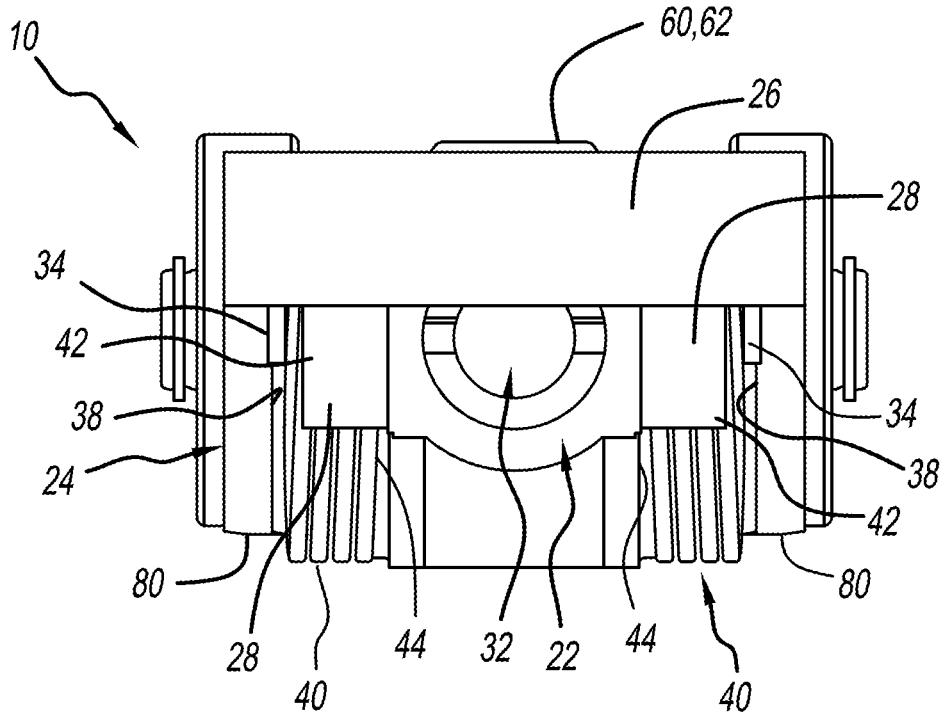
FIG. 3 is a first end view of the switching rocker arm of FIG. 1.

The inner arm 22 is mounted over the hydraulic lash adjuster and interfaces with a ball socket area of the lash adjuster in a tangential contact. The latch pin 32 is positioned at the rear side of the inner arm 22 extending outward, away from the rocker arm 10 for latching, and a pair of engagement wings or tabs 28 extend outwardly from inner arm sidewalls 30. The outer arm 24 is connected to the inner arm 22 on either side through a torsion spring first end 34 while a second end 36 (FIG. 2) is restrained by the inner arm 22. As shown in FIG. 2, torsion spring first end 34 contacts connecting arm 26 and is restrained from outward movement (arrow A) by outer arm inner walls 38, and is restrained from inward movement (arrow B) by an outer surface 42 of engagement tabs 28. Each torsion spring 40 inner diameter can be placed over a post 44 on either side of the inner arm 22.

The rocker arm assembly 10 includes a compact design for improved kinematics. The rocker arm assembly 10 provides reduced mass over valve for improved dynamics. The main rocker event is over roller design for optimized friction. The overall rocker arm packaging is optimized specifically for a given engine.

With reference to FIGS. 5-9, an exemplary switching rocker arm assembly constructed in accordance with one example of the present disclosure is shown and generally identified at reference 100. The switching rocker arm assembly 100 can be a compact cam-driven single-lobe cylinder deactivation (CDA-1L) switching rocker arm installed on a piston-driven internal combustion engine, and actuated with the combination of a dual-feed hydraulic lash adjusters (DFHLA) and oil control valves (OCV). The switching rocker arm assembly 100 can include an inner arm 122 and an outer arm 124. The default configuration is in the normal-lift (latched) position where the inner arm 122 and the outer arm 124 are locked together, causing an engine valve to open and allowing the cylinder to operate as it would in a standard valvetrain. The DFHLA has two oil ports. A lower oil port provides lash compensation and is fed engine oil similar to a standard HLA. An upper oil port, referred as the switching pressure port, provides the conduit between controlled oil pressure from the OCV and a latch 132. When the latch 132 is engaged, the inner arm 122 and the outer arm 124 operate together like a standard rocker arm to open the engine valve. The inner arm 122 may include a rear stopper (not shown) that is configured to engage the outer arm 124. In the no-lift (unlatched) position, the inner arm 122 and the outer arm 124 can move independently to enable cylinder deactivation. A pair of lost motion torsion springs 140 are incorporated to bias the position of the inner arm 122 so that it always maintains continuous contact with the camshaft lobe.

The inner arm 122 and the outer arm 124 are both mounted to a pivot axle (not shown) similar to that shown herein, for example, FIG. 4. The pivot axle can be located adjacent to a first end of the rocker arm assembly 100, which secures the inner arm 122 to the outer arm 124 while also allowing a rotational degree of freedom pivoting about the pivot axle when the rocker arm assembly 100 is in a deactivated state. In addition to the example having a separate pivot axle mounted to the outer arm 124 and the inner arm 122, the pivot axle may be integral to the outer arm 124 or to the inner arm 122. The rocker arm assembly 100 can include a bearing having a roller (not shown) that is mounted between inner side arms that form the inner arm 122 on a bearing axle that, during normal operation of the rocker arm assembly 100 serves to transfer energy from a rotating cam to the rocker arm assembly 100.

The switching rocker arm assembly 100 enables the variability in valve lift by inducing lost motion for one lift profile while transmitting the secondary lift profile to the valve or vice versa. Generally, the latching pin or connecting mechanism tightly controlled to minimize the effect of the clearance on to the valve lift. However, depending on the application and purpose of the secondary valve lift, not all designs need to be tightly controlled. In one such application, where latch clearance to the interfacing arm is not having a wider pronounced effect on the valve. A design that could achieve this configuration has optimal requirements in the manufacturing process. There are also benefits in terms of compactness, cost and better kinematic performance with further optimization of the rocker arm parameters layout.

The rocker arm assembly 100 achieves the main valve lift in the roller and the secondary valve lift in slider pads 180 due to the application duty cycle. A normally unlatched design employed to selectively use the secondary valve lift when required per the engine duty cycle. The inner arm 122 houses the bearing and roller, while the outer arm 124 includes a connecting arm 126 and encompasses the slider pads 180 in the cam interface area. The pivot axle connects both the inner and outer arms 122, 124 and is placed over the top of the engine valve.

Figure 6:
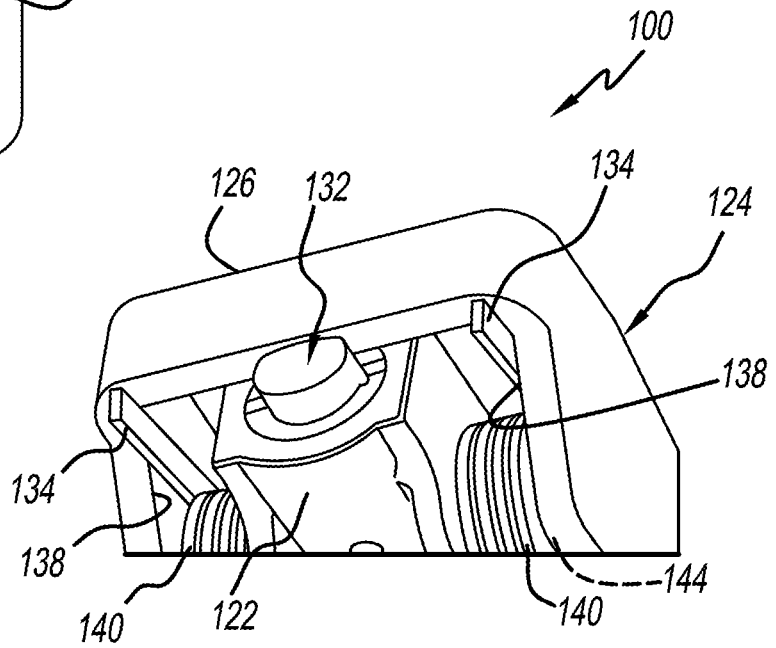
FIG. 6 is a partial perspective view of a switching rocker arm constructed in accordance to another example of the present disclosure and incorporating the outer rocker arm of FIG. 5.
Figure 7:
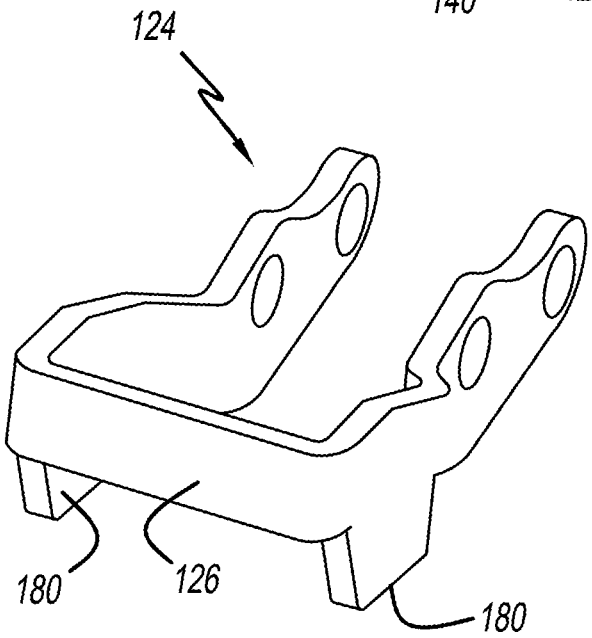
FIG. 7 is a top perspective view of the outer rocker arm of FIG. 5.
Figure 8:
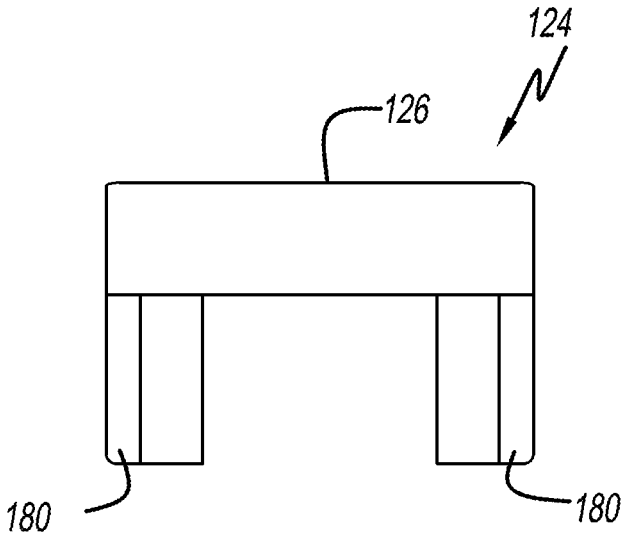
FIG. 8 is a rear view of the outer rocker arm of FIG. 5.
Figure 9:
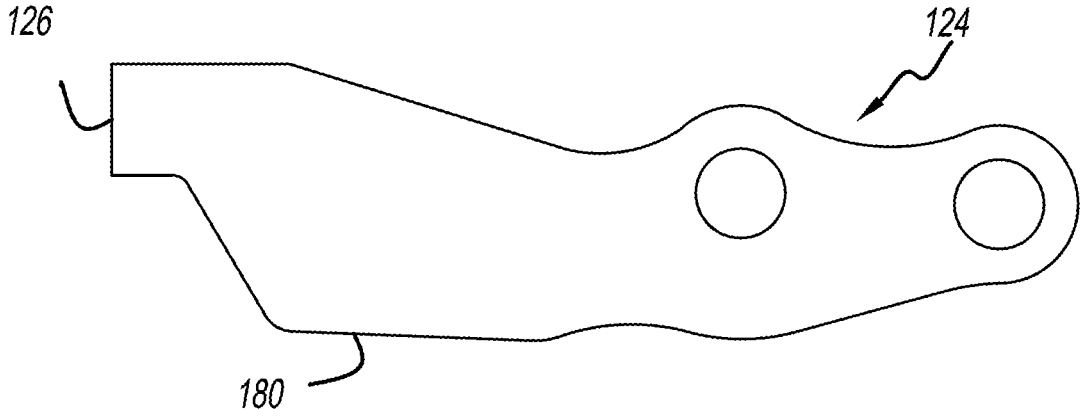
FIG. 9 is a side view of the outer rocker arm of FIG. 5.

The inner arm 122 is mounted over the hydraulic lash adjuster and interfaces with a ball socket area of the lash adjuster in a tangential contact. The latch pin 132 is positioned at the rear side of the inner arm 122 extending outward, away from the rocker arm 100 for latching. The outer arm 124 is connected to the inner arm 122 on either side through a torsion spring first end 134 while a second end (not shown) is restrained by the inner arm 122 in a manner similar to that shown herein, for example, FIGS. 1-4. As shown in FIG. 6, torsion spring first end 134 contacts connecting arm 126 and is restrained from outward movement by outer arm inner walls 138. Each torsion spring 140 inner diameter can be placed over a post 144 on either side of the inner arm 122.

Figure 10:
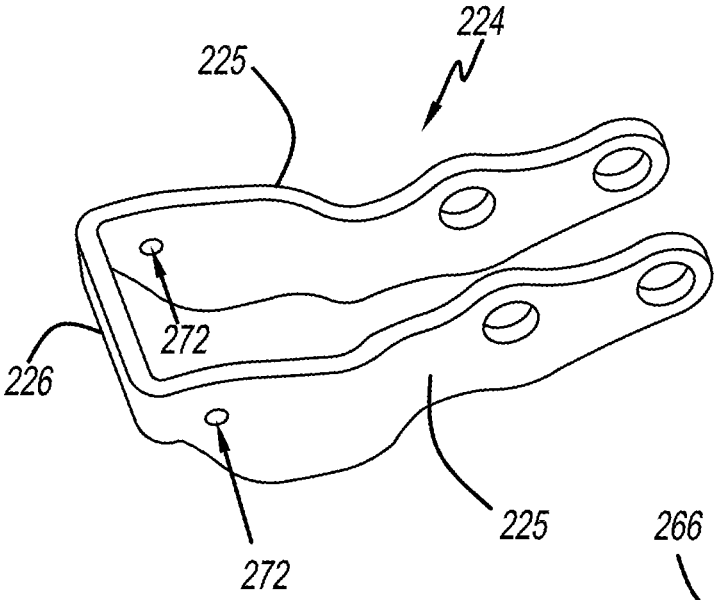
FIG. 10 is a top perspective view of an outer rocker arm constructed in accordance to another example of the present disclosure.
Figure 11:
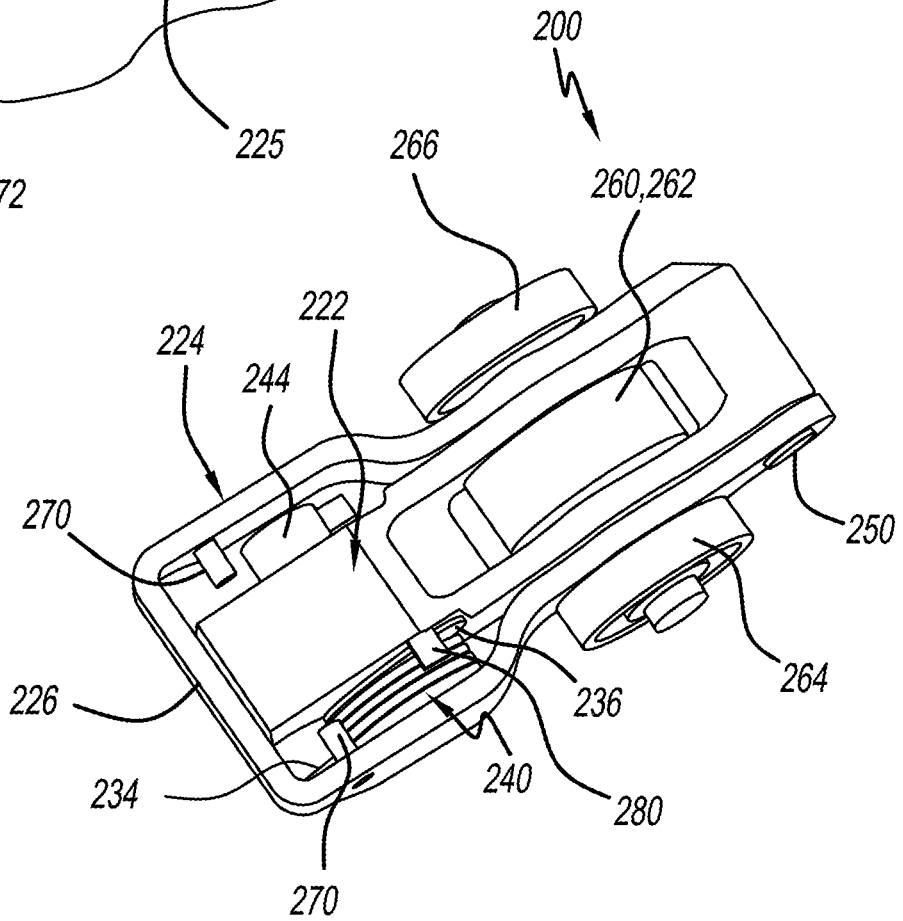
FIG. 11 is a top perspective view of a switching rocker arm constructed in accordance to yet another example of the present disclosure.
Figure 12:
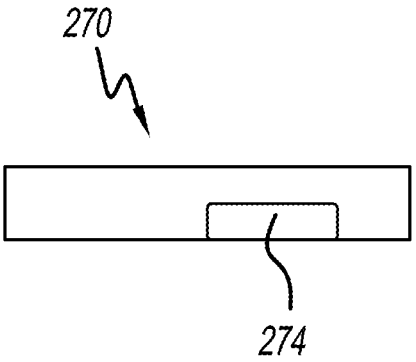
FIG. 12 is a side view of a connecting pin used in the switching rocker arm of FIG. 11, the connecting pin having a notch for receiving a spring end.
Figure 13:
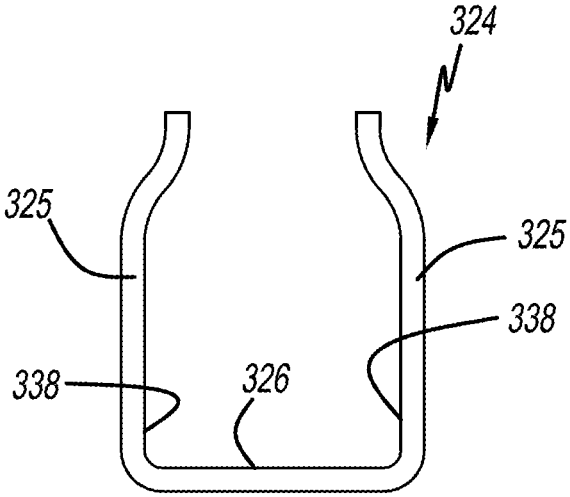
FIG. 13 is a partial top view of an outer rocker arm constructed in accordance to an additional example of the present disclosure.

With reference to FIGS. 10-12, an exemplary switching rocker arm assembly constructed in accordance with one example of the present disclosure is shown and generally identified at reference 200. The switching rocker arm assembly 200 can be a compact cam-driven single-lobe cylinder deactivation (CDA-1L) switching rocker arm installed on a piston-driven internal combustion engine, and actuated with the combination of a dual-feed hydraulic lash adjusters (DFHLA) and oil control valves (OCV). The switching rocker arm assembly 200 can be engaged by a single lobe cam. The switching rocker arm assembly 200 can include an inner arm 222 and an outer arm 224. The default configuration is in the normal-lift (latched) position where the inner arm 222 and the outer arm 224 are locked together, causing an engine valve to open and allowing the cylinder to operate as it would in a standard valvetrain. The DFHLA has two oil ports. A lower oil port provides lash compensation and is fed engine oil similar to a standard HLA. An upper oil port, referred as the switching pressure port, provides the conduit between controlled oil pressure from the OCV and a latch (not shown) similar to that shown herein (e.g., FIGS. 1-4). When the latch is engaged, the inner arm 222 and the outer arm 224 operate together like a standard rocker arm to open the engine valve. The inner arm 222 may include a rear stopper (not shown) that is configured to engage the outer arm 224. In the no-lift (unlatched) position, the inner arm 222 and the outer arm 224 can move independently to enable cylinder deactivation. A pair of lost motion torsion springs 240 (only one shown in FIG. 11) are incorporated to bias the position of the inner arm 222 so that it always maintains continuous contact with the camshaft lobe.

The inner arm 222 and the outer arm 224 are both mounted to a pivot axle 250. The pivot axle 250 can be located adjacent to a first end of the rocker arm assembly 200, which secures the inner arm 222 to the outer arm 224 while also allowing a rotational degree of freedom pivoting about the pivot axle 250 when the rocker arm assembly 200 is in a deactivated state. In addition to the illustrated example having a separate pivot axle 250 mounted to the outer arm 224 and the inner arm 222, the pivot axle 250 may be integral to the outer arm 224 or to the inner arm 222. The rocker arm assembly 200 can include a bearing 260 having an inner roller 262 that is mounted between inner side arms that form the inner arm 222 on a bearing axle that, during normal operation of the rocker arm assembly 200 serves to transfer energy from a rotating cam to the rocker arm assembly 200. A pair of outer rollers 264, 266 are mounted on the outer arm 224.

The switching rocker arm assembly 200 enables the variability in valve lift by inducing lost motion for one lift profile while transmitting the secondary lift profile to the valve or vice versa. Generally, the latching pin or connecting mechanism tightly controlled to minimize the effect of the clearance on to the valve lift. However, depending on the application and purpose of the secondary valve lift, not all designs need to be tightly controlled. In one such application, where latch clearance to the interfacing arm is not having a wider pronounced effect on the valve. A design that could achieve this configuration has optimal requirements in the manufacturing process. There are also benefits in terms of compactness, cost and better kinematic performance with further optimization of the rocker arm parameters layout.

The rocker arm assembly 200 achieves the main valve lift in the inner roller 262 on the inner arm 222 and the secondary valve lift on the outer rollers 264, 266 on the outer arm 224 due to the application duty cycle. A normally unlatched design employed to selectively use the secondary valve lift when required per the engine duty cycle. The inner arm 222 houses the bearing 260 and roller 262, while the outer arm 224 includes outer arm portions 225 and a connecting arm 226. The pivot axle 250 connects both the inner and outer arms 222, 224 and is placed over the top of the engine valve.

The inner arm 222 is mounted over the hydraulic lash adjuster and interfaces with a ball socket area of the lash adjuster in a tangential contact. The latch pin is positioned at the rear side of the inner arm 222 extending outward, away from the rocker arm 200 for latching. The outer arm 224 is connected to the inner arm 222 on either side through a torsion spring first end 234 while a second end 236 is restrained by the inner arm 222. As shown in FIG. 11, torsion spring first end 234 contacts connecting pins 270, which are inserted into apertures 272 and extend from outer arms 224. As shown in FIG. 12, each connecting pin 270 includes a notch 274 to receive torsion spring leg 234 from both outward and inward movement. In one example, the respective second ends 236 are restrained by outwardly extending protrusions 238 extending from the inner arm 222. Each torsion spring 240 inner diameter can be placed over a post 244 on either side of the inner arm 222. The torsion springs 240 can be positioned generally over the valve. In another example, the torsion springs 240 can be positioned over the pivot 250. The rocker arm assembly 200 includes a compact design for improved kinematics. The rocker arm assembly 200 provides reduced mass over valve for improved dynamics. The main rocker event is over roller design for optimized friction. The overall rocker arm packaging is optimized specifically for a given engine.

With reference to FIGS. 13-17, an exemplary switching rocker arm assembly constructed in accordance to one example of the present disclosure is shown and generally identified at reference 300. The switching rocker arm assembly 300 can be a compact cam- driven single-lobe cylinder deactivation (CDA-1L) switching rocker arm installed on a piston- driven internal combustion engine, and actuated with the combination of a dual-feed hydraulic lash adjusters (DFHLA) and oil control valves (OCV). The switching rocker arm assembly 300 can be engaged by a single lobe cam. The switching rocker arm assembly 300 can include an inner arm 322 and an outer arm 324. The outer arm 324 generally includes a pair of outer arm portion 325 and a connecting arm 326 extending therebetween. The default configuration is in the normal-lift (latched) position where the inner arm 322 and the outer arm 324 are locked together, causing an engine valve to open and allowing the cylinder to operate as it would in a standard valvetrain. The DFHLA has two oil ports. A lower oil port provides lash compensation and is fed engine oil similar to a standard HLA. An upper oil port, referred as the switching pressure port, provides the conduit between controlled oil pressure from the OCV and a latch 332. When the latch 332 is engaged, the inner arm 322 and the outer arm 324 operate together like a standard rocker arm to open the engine valve. The inner arm 322 may include a rear stopper (not shown) that is configured to engage the outer arm 324. In the no-lift (unlatched) position, the inner arm 322 and the outer arm 324 can move independently to enable cylinder deactivation. A pair of lost motion torsion springs 340 are incorporated to bias the position of the inner arm 322 so that it always maintains continuous contact with the camshaft lobe.

The inner arm 322 and the outer arm 324 are both mounted to a pivot axle (not shown) similar to that described herein. The pivot axle can be located adjacent to a first end of the rocker arm assembly 300, which secures the inner arm 322 to the outer arm 324 while also allowing a rotational degree of freedom pivoting about the pivot axle when the rocker arm assembly 300 is in a deactivated state. In addition to the example having a separate pivot axle mounted to the outer arm 324 and the inner arm 322, the pivot axle may be integral to the outer arm 324 or to the inner arm 322. The rocker arm assembly 300 can include a bearing 360 having a roller 362 that is mounted between inner side arms that form the inner arm 322 on a bearing axle that, during normal operation of the rocker arm assembly 300 serves to transfer energy from a rotating cam to the rocker arm assembly 300.

The switching rocker arm assembly 300 enables the variability in valve lift by inducing lost motion for one lift profile while transmitting the secondary lift profile to the valve or vice versa. Generally, the latching pin or connecting mechanism tightly controlled to minimize the effect of the clearance on to the valve lift. However, depending on the application and purpose of the secondary valve lift, not all designs need to be tightly controlled. In one such application, where latch clearance to the interfacing arm is not having a wider pronounced effect on the valve. A design that could achieve this configuration has optimal requirements in the manufacturing process. There are also benefits in terms of compactness, cost and better kinematic performance with further optimization of the rocker arm parameters layout.

The rocker arm assembly 300 achieves the main valve lift in the roller 360 and the secondary valve lift in slider pads 380 due to the application duty cycle. It will be appreciated that a three-roller configuration, such as described herein, may be incorporated instead of the single roller, slider pad configuration. A normally unlatched design employed to selectively use the secondary valve lift when required per the engine duty cycle. The inner arm 322 houses the bearing 360 and roller 362, while the outer arm 324 includes a connecting arm 326 and encompasses the slider pads 380 in the cam interface area. The pivot axle connects both the inner and outer arms 322, 324 and is placed over the top of the engine valve.

Figure 14:
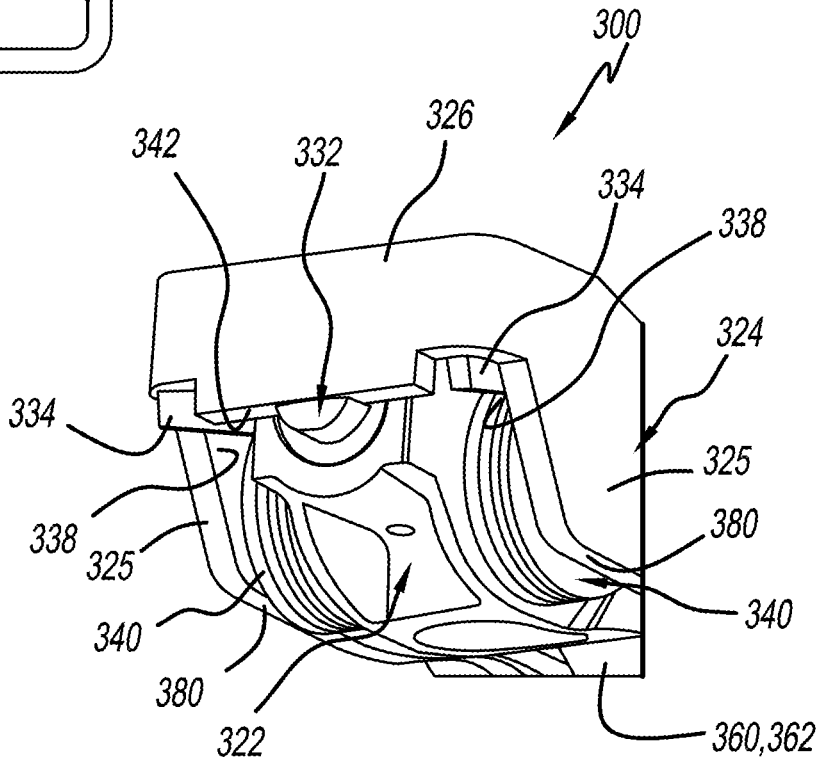
FIG. 14 is a partial perspective view of a switching rocker arm constructed in accordance to another example of the present disclosure and incorporating the outer rocker arm of FIG. 13.
Figure 15:
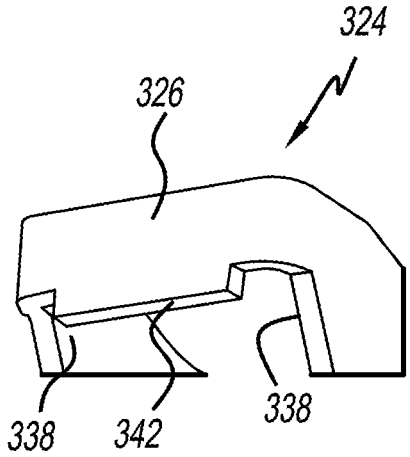
FIG. 15 is a partial rear perspective view of the outer rocker arm of FIG. 13.
Figure 16:
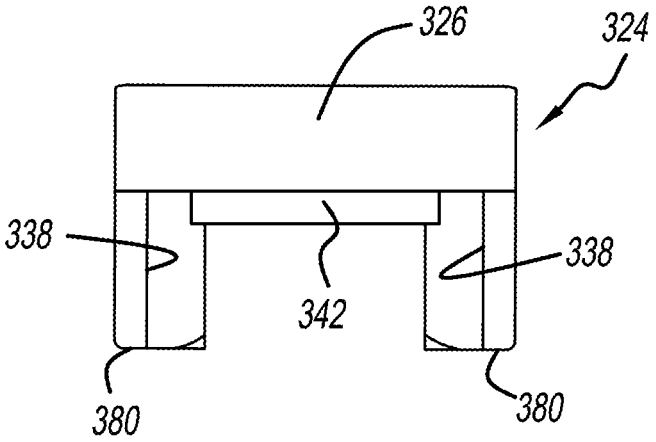
FIG. 16 is a rear view of the outer rocker arm of FIG. 13.
Figure 17:
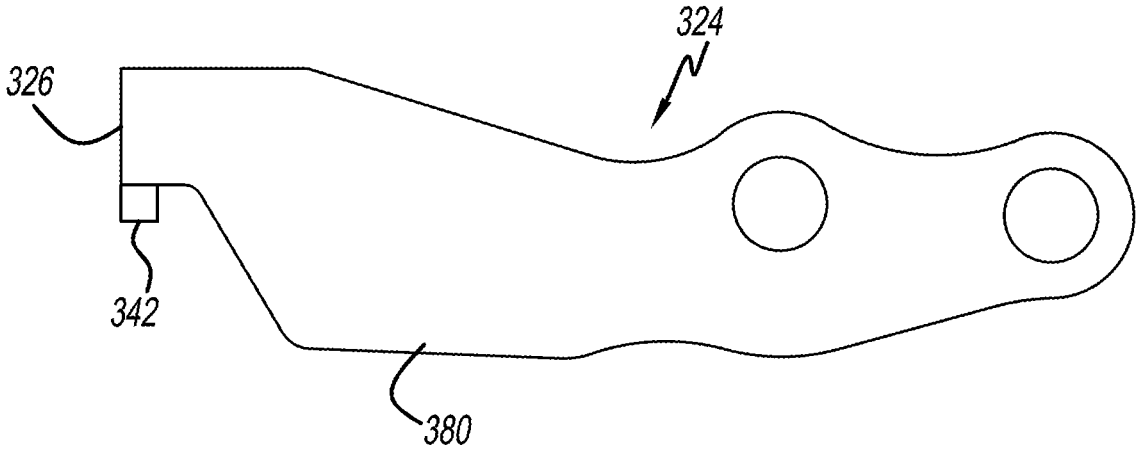
FIG. 17 is a side view of the outer rocker arm of FIG. 13.

The inner arm 322 is mounted over the hydraulic lash adjuster and interfaces with a ball socket area of the lash adjuster in a tangential contact. The latch pin 332 is positioned at the rear side of the inner arm 322 extending outward, away from the rocker arm 300 for latching. The outer arm 324 is connected to the inner arm 322 on either side through a torsion spring first end 334 while a second end (not shown) is restrained by the inner arm 322 in a similar manner as described herein. As shown in FIG. 14, torsion spring first end 334 contacts connecting arm 326 and is restrained from outward movement by outer arm inner walls 338, and is restrained from inward movement by an outwardly extending tab 342 of connecting arm 326. Each torsion spring 340 inner diameter can be placed over a post (not shown) on either side of the inner arm 322 similar to that described herein, for example, in FIGS. 1-4. The rocker arm assembly 300 includes a compact design for improved kinematics. The rocker arm assembly 300 provides reduced mass over valve for improved dynamics. The main rocker event is over roller design for optimized friction. The overall rocker arm packaging is optimized specifically for a given engine.

Figure 18:
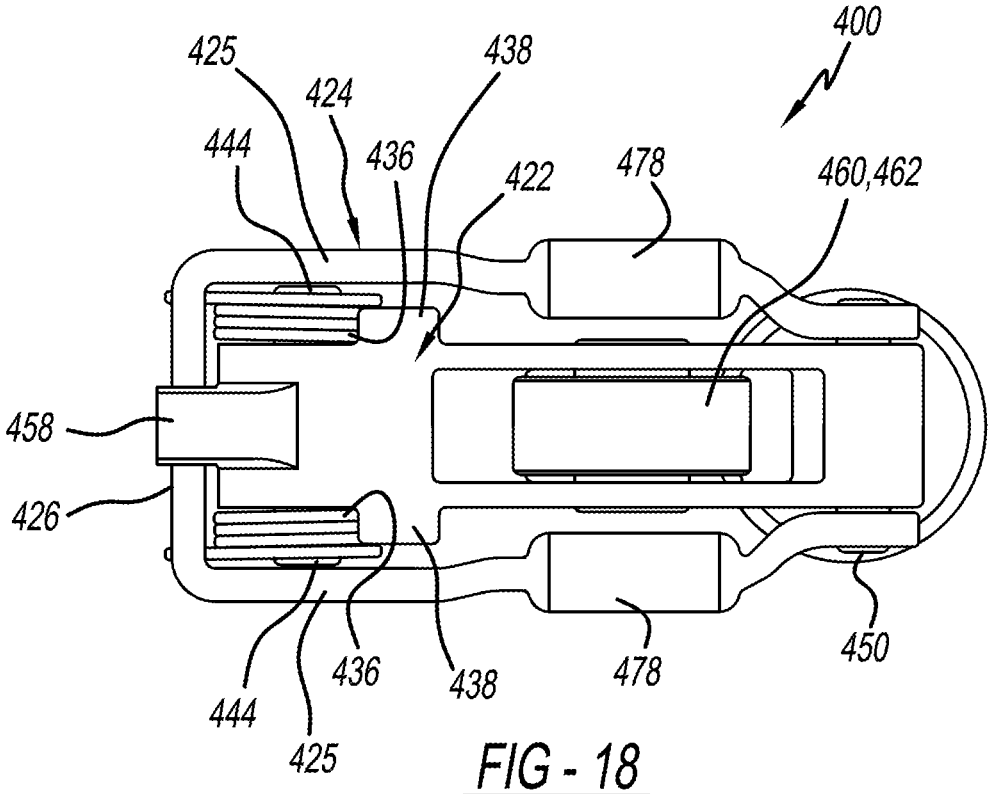
FIG. 18 is a top view of a switching rocker arm constructed in accordance to another example of the present disclosure.
Figure 19:
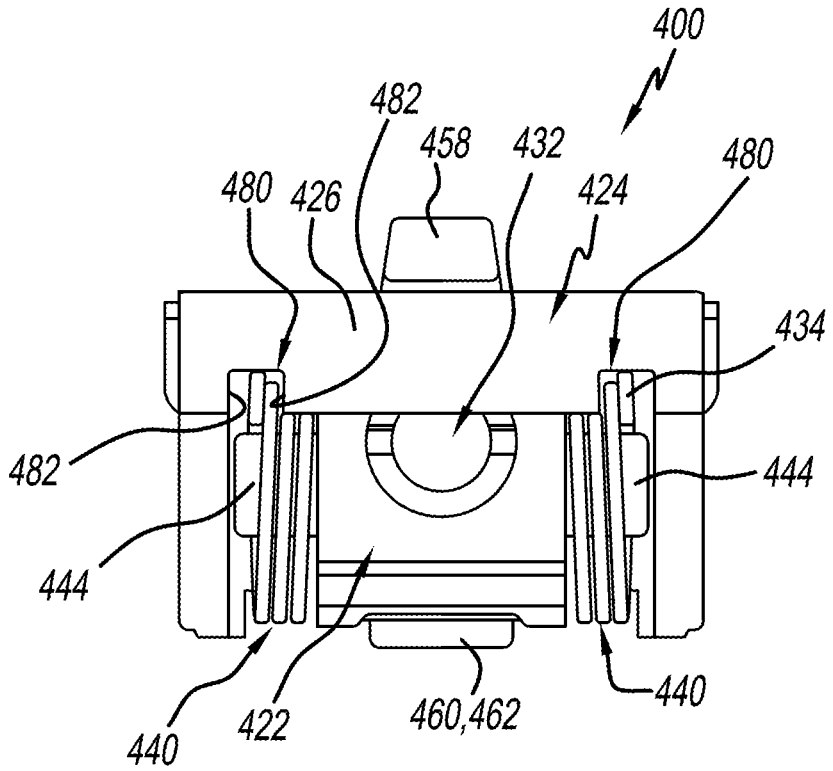
FIG. 19 is an end view of the switching rocker arm of FIG. 18.

With reference to FIGS. 18 and 19, an exemplary switching rocker arm assembly constructed in accordance to one example of the present disclosure is shown and generally identified at reference 400. The switching rocker arm assembly 400 can be a compact cam-driven single-lobe cylinder deactivation (CDA-1L) switching rocker arm installed on a piston-driven internal combustion engine, and actuated with the combination of a dual-feed hydraulic lash adjusters (DFHLA) and oil control valves (OCV). The switching rocker arm assembly 400 can include an inner arm 422 and an outer arm 424. The outer arm 424 generally includes a pair of outer arm portion 425 and a connecting arm 426 extending therebetween. The default configuration is in the normal-lift (latched) position where the inner arm 422 and the outer arm 424 are locked together, causing an engine valve to open and allowing the cylinder to operate as it would in a standard valvetrain. The DFHLA has two oil ports. A lower oil port provides lash compensation and is fed engine oil similar to a standard HLA. An upper oil port, referred as the switching pressure port, provides the conduit between controlled oil pressure from the OCV and a latch 432. When the latch 432 is engaged, the inner arm 422 and the outer arm 424 operate together like a standard rocker arm to open the engine valve. The inner arm 422 may include a rear stopper 458 that is configured to engage the outer arm 424. In the no-lift (unlatched) position, the inner arm 422 and the outer arm 424 can move independently to enable cylinder deactivation. A pair of lost motion torsion springs 440 are incorporated to bias the position of the inner arm 422 so that it always maintains continuous contact with the camshaft lobe.

The inner arm 422 and the outer arm 424 are both mounted to a pivot axle 450. The pivot axle 450 can be located adjacent to a first end of the rocker arm assembly 400, which secures the inner arm 422 to the outer arm 424 while also allowing a rotational degree of freedom pivoting about the pivot axle 450 when the rocker arm assembly 400 is in a deactivated state. In addition to the illustrated example having a separate pivot axle 450 mounted to the outer arm 424 and the inner arm 422, the pivot axle 450 may be integral to the outer arm 424 or to the inner arm 422. The rocker arm assembly 400 can include a bearing 460 having a roller 462 that is mounted between inner side arms that form the inner arm 422 on a bearing axle that, during normal operation of the rocker arm assembly 400 serves to transfer energy from a rotating cam to the rocker arm assembly 400.

The switching rocker arm assembly 400 enables the variability in valve lift by inducing lost motion for one lift profile while transmitting the secondary lift profile to the valve or vice versa. Generally, the latching pin or connecting mechanism tightly controlled to minimize the effect of the clearance on to the valve lift. However, depending on the application and purpose of the secondary valve lift, not all designs need to be tightly controlled. In one such application, where latch clearance to the interfacing arm is not having a wider pronounced effect on the valve. A design that could achieve this configuration has optimal requirements in the manufacturing process. There are also benefits in terms of compactness, cost and better kinematic performance with further optimization of the rocker arm parameters layout.

The rocker arm assembly 400 achieves the main valve lift in the roller 460 and the secondary valve lift in slider pads 478 due to the application duty cycle. A normally unlatched design employed to selectively use the secondary valve lift when required per the engine duty cycle. The inner arm 422 houses the bearing 460 and roller 462, while the outer arm 424 includes a connecting arm 426 and encompasses the slider pads 478 in the cam interface area. The pivot axle 450 connects both the inner and outer arms 422, 424 and is placed over the top of the engine valve.

The inner arm 422 is mounted over the hydraulic lash adjuster and interfaces with a ball socket area of the lash adjuster in a tangential contact. The latch pin 432 is positioned at the rear side of the inner arm 422 extending outward, away from the rocker arm 400 for latching. The outer arm 424 is connected to the inner arm 422 on either side through a torsion spring first end 434 while a second end 436 is restrained by the inner arm 422. In one example, the respective second ends 436 are restrained by outwardly extending protrusions or wings 438 extending from the inner arm 422. As shown in FIG. 19, each torsion spring first end 434 is disposed in a notch 480 of connecting arm 426 and is restrained from inward/outward movement by walls 482 of the notch 480. Each torsion spring 440 inner diameter can be placed over a post 444 on either side of the inner arm 422. The rocker arm assembly 400 includes a compact design for improved kinematics. The rocker arm assembly 400 provides reduced mass over valve for improved dynamics. The main rocker event is over roller design for optimized friction. The overall rocker arm packaging is optimized specifically for a given engine. It will be appreciated that while the rocker arm 400 is shown and described having slider pads 478, the rocker arm 400 may alternatively comprise the three roller configuration described herein.

Figure 20:
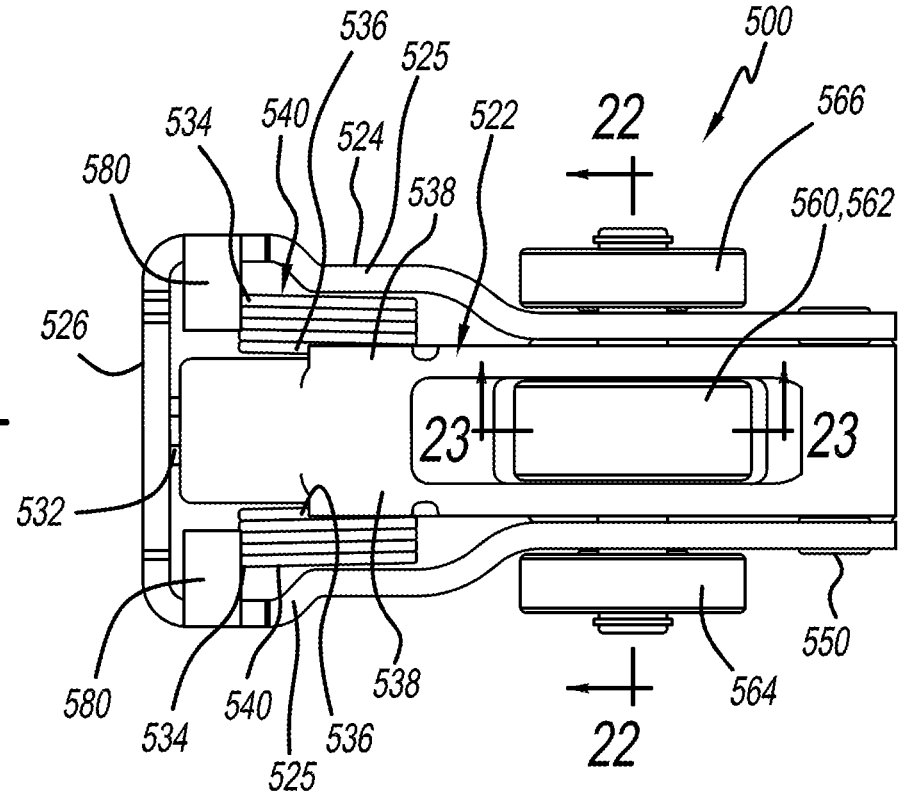
FIG. 20 is a top view of a switching rocker arm constructed in accordance to another example of the present disclosure.
Figure 21:
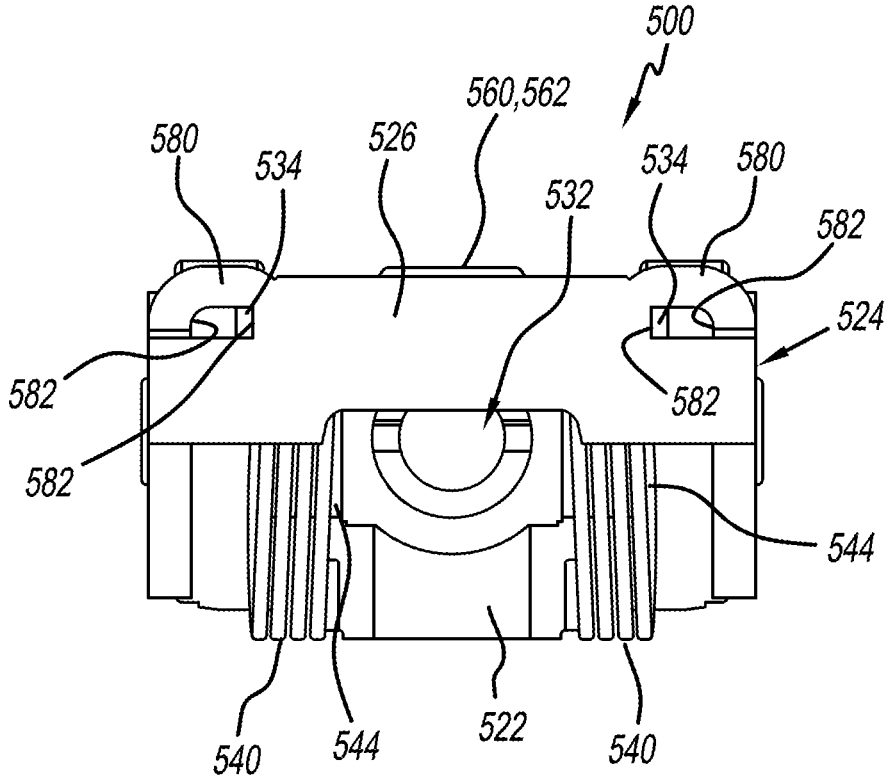
FIG. 21 is an end view of the switching rocker arm of FIG. 20.

With reference to FIGS. 20 and 21, an exemplary switching rocker arm assembly constructed in accordance to one example of the present disclosure is shown and generally identified at reference 500. The switching rocker arm assembly 500 can be a compact cam-driven single-lobe cylinder deactivation (CDA-1L) switching rocker arm installed on a piston-driven internal combustion engine, and actuated with the combination of a dual-feed hydraulic lash adjusters (DFHLA) and oil control valves (OCV). The switching rocker arm assembly 500 can be engaged by a single lobe cam. The switching rocker arm assembly 500 can include an inner arm 522 and an outer arm 524. The outer arm 524 generally includes a pair of outer arm portion 525 and a connecting arm 526 extending therebetween. The default configuration is in the normal-lift (latched) position where the inner arm 522 and the outer arm 524 are locked together, causing an engine valve to open and allowing the cylinder to operate as it would in a standard valvetrain. The DFHLA has two oil ports. A lower oil port provides lash compensation and is fed engine oil similar to a standard HLA. An upper oil port, referred as the switching pressure port, provides the conduit between controlled oil pressure from the OCV and a latch 532. When the latch 532 is engaged, the inner arm 522 and the outer arm 524 operate together like a standard rocker arm to open the engine valve. The inner arm 522 may include a rear stopper (not shown) that is configured to engage the outer arm 524. In the no-lift (unlatched) position, the inner arm 522 and the outer arm 524 can move independently to enable cylinder deactivation. A pair of lost motion torsion springs 540 are incorporated to bias the position of the inner arm 522 so that it always maintains continuous contact with the camshaft lobe.

The inner arm 522 and the outer arm 524 are both mounted to a pivot axle 550. The pivot axle 550 can be located adjacent to a first end of the rocker arm assembly 500, which secures the inner arm 522 to the outer arm 524 while also allowing a rotational degree of freedom pivoting about the pivot axle 550 when the rocker arm assembly 500 is in a deactivated state. In addition to the illustrated example having a separate pivot axle 550 mounted to the outer arm 524 and the inner arm 522, the pivot axle 550 may be integral to the outer arm 524 or to the inner arm 522. The rocker arm assembly 500 can include a bearing 560 having an inner roller 562 that is mounted between inner side arms that form the inner arm 522 on a bearing axle that, during normal operation of the rocker arm assembly 500 serves to transfer energy from a rotating cam to the rocker arm assembly 500. A pair of outer rollers 564, 566 are mounted on the outer arm 524.

The switching rocker arm assembly 500 enables the variability in valve lift by inducing lost motion for one lift profile while transmitting the secondary lift profile to the valve or vice versa. Generally, the latching pin or connecting mechanism tightly controlled to minimize the effect of the clearance on to the valve lift. However, depending on the application and purpose of the secondary valve lift, not all designs need to be tightly controlled. In one such application, where latch clearance to the interfacing arm is not having a wider pronounced effect on the valve. A design that could achieve this configuration has optimal requirements in the manufacturing process. There are also benefits in terms of compactness, cost and better kinematic performance with further optimization of the rocker arm parameters layout.

The rocker arm assembly 500 achieves the main valve lift in the inner roller 562 on the inner arm 522 and the secondary valve lift on the outer rollers 564, 566 due to the application duty cycle. A normally unlatched design employed to selectively use the secondary valve lift when required per the engine duty cycle. The inner arm 522 houses the bearing 560 and roller 562, while the outer arm 524 accommodates the outer rollers 564, 566. The pivot axle 550 connects both the inner and outer arms 522, 524 and is placed over the top of the engine valve. It will be appreciated that the three roller configuration described for use on the rocker arm assembly 500 can be incorporated on any of the other rocker arm assemblies such as the rocker arm assemblies 100 and 300 described herein.

The inner arm 522 is mounted over the hydraulic lash adjuster and interfaces with a ball socket area of the lash adjuster in a tangential contact. The latch pin 532 is positioned at the rear side of the inner arm 522 extending outward, away from the rocker arm 500 for latching. The outer arm 524 is connected to the inner arm 522 on either side through a torsion spring first end 534 while a second end 536 is restrained by the inner arm 522. In one example, the respective second ends 536 are restrained by an outwardly extending protrusion or wings 538 extending from the inner arm 522.

As shown in FIGS. 20 and 21, each torsion spring first end 534 is disposed in a hook or an arm 580, which extends inwardly from outer arm 524, and is restrained from inward/outward movement by sidewalls 582 of the arm 580. Each torsion spring 540 inner diameter can be placed over a post 544 on either side of the inner arm 522. The rocker arm assembly 500 includes a compact design for improved kinematics. The rocker arm assembly 500 provides reduced mass over valve for improved dynamics. The main rocker event is over roller design for optimized friction. The overall rocker arm packaging is optimized specifically for a given engine.

Figure 22:
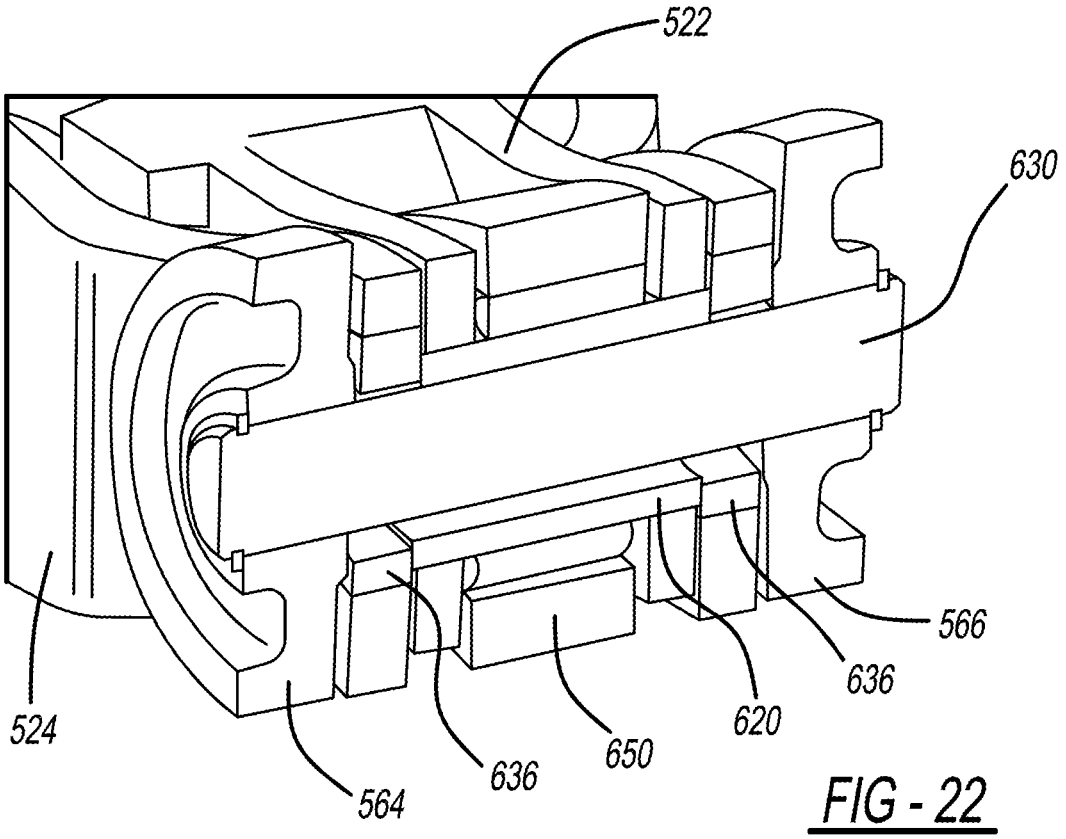
FIG. 22 is a cross sectional view of the three roller configuration taken along lines 22-22 of FIG. 20.
Figure 23:
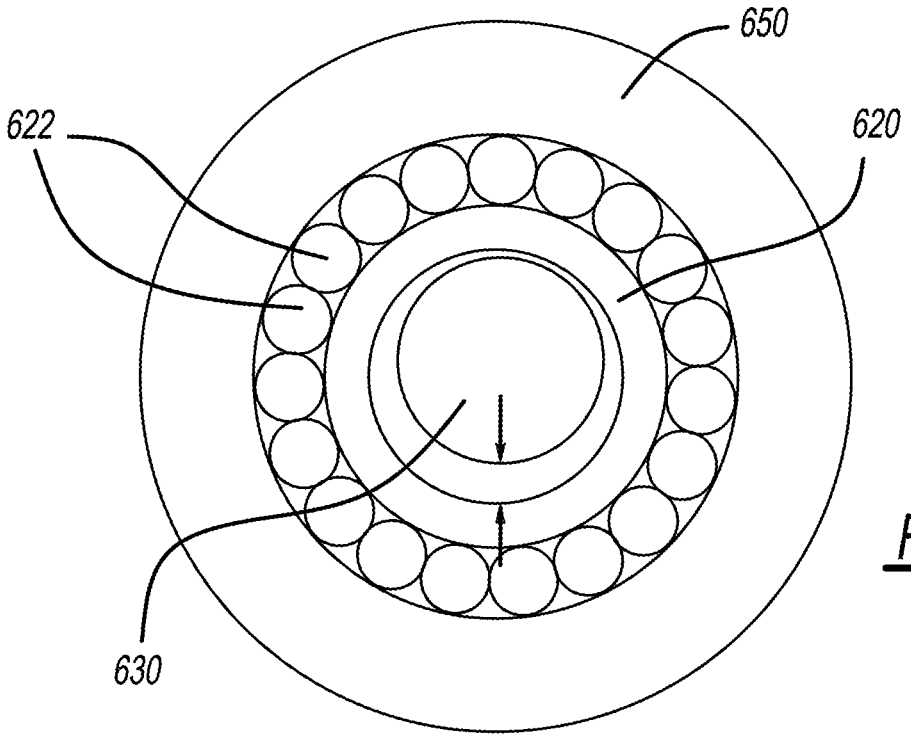
FIG. 23 is a cross-sectional view of the needle bearing taken along lines 23-23 of FIG. 20

With reference now to FIGS. 22 and 23 additional features of the instant application will be described. The three roller concept provides lost motion. For example, using the rocker arm 500 (FIGS. 20 and 21), the bearing 560 can be a needle bearing having a hollow axle 620 and a plurality of needles 622. An outer arm roller axle 630 is positioned eccentrically relative to the hollow axle 620 to account for lost motion. The outer arm 524 has a pair of stopper bushings 636 configured thereon at the interface with the roller axle 630. It will be appreciated that the additional features of the three roller concept shown in FIGS. 22 and 23 may be incorporated into any of the rocker arms disclosed herein. The three roller configuration reduces friction compared to traditional slider pad arrangements. It will further be appreciated that the rocker arm configurations described herein are arranged into a valvetrain such that they are positioned having the latch (i.e. 32, 232, 432 and 532) positioned over the pivot (i.e. 50, 250, 450 and 550) to maintain optimal weight distribution. In this regard, the pivot is aligned on the valve end wherein the latch is aligned (in some examples in an elevated relationship relative to the pivot end) on the HLA end.

Figure 24:
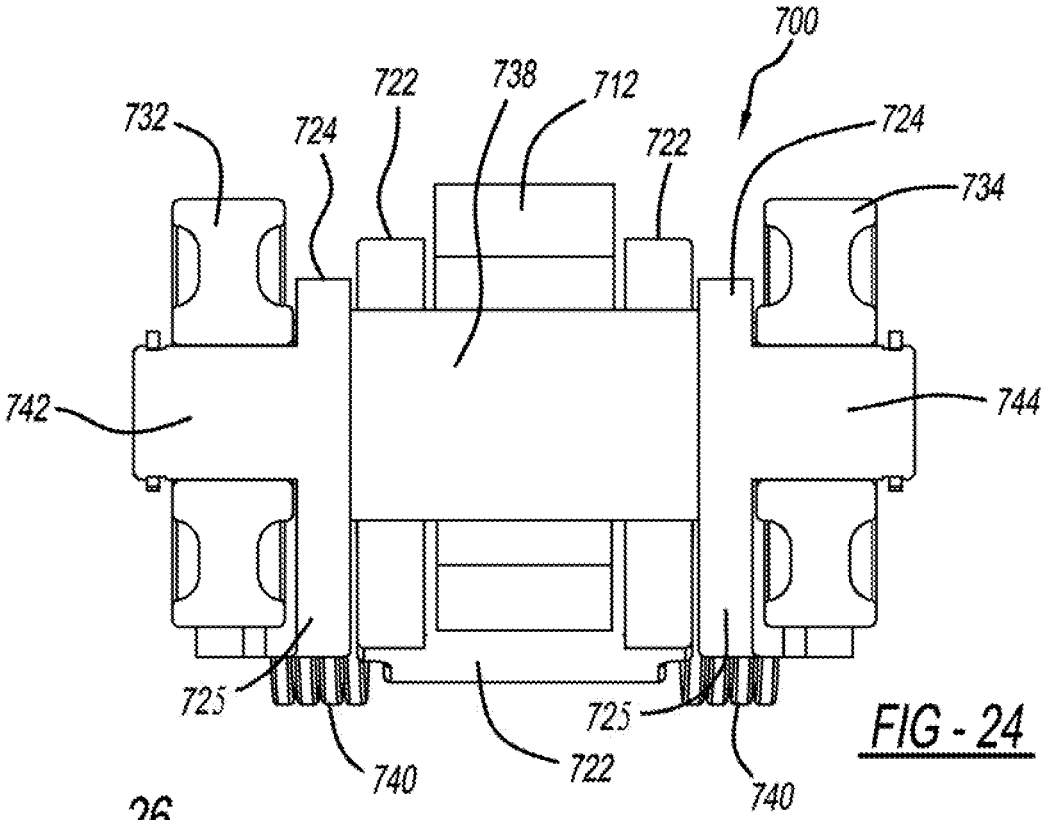
FIG. 24 is a cross-sectional view of a three roller rocker arm constructed in accordance to additional features and having an outer arm that has integral roller axles.

Turning now to FIG. 24, a cross sectional view of a rocker arm 700 constructed in accordance to additional features is shown. The rocker arm 700 incorporates a three roller configuration including an inner roller 712 provided on an inner rocker arm 722 and outer rollers 732 and 734 arranged on the outer rocker arm 724. The inner roller 712 is mounted on an inner axle 738. The outer rollers 732 and 734 are mounted on outer axles 742 and 744. The outer axles 742 and 744 are integrally formed with the outer rocker arm 724. The outer rollers 732 and 734 may be retained by snap rings or other means. A pair of biasing mechanisms 740 can be included. In one example, a stacked grinding wheel and stacked regulating wheel can be used to create the respective outer axles 742 and 744. The resulting posts can be subsequently ground on a V-block. An inner axle 738 is mounted to the inner arm 722 and between outer arm portions 725 of the outer rocker arm 724. The inner roller 712 is mounted on the inner axle 738. The integrally formed axles 742, 744 are positioned on either side of the inner axle 738.

Figure 25:
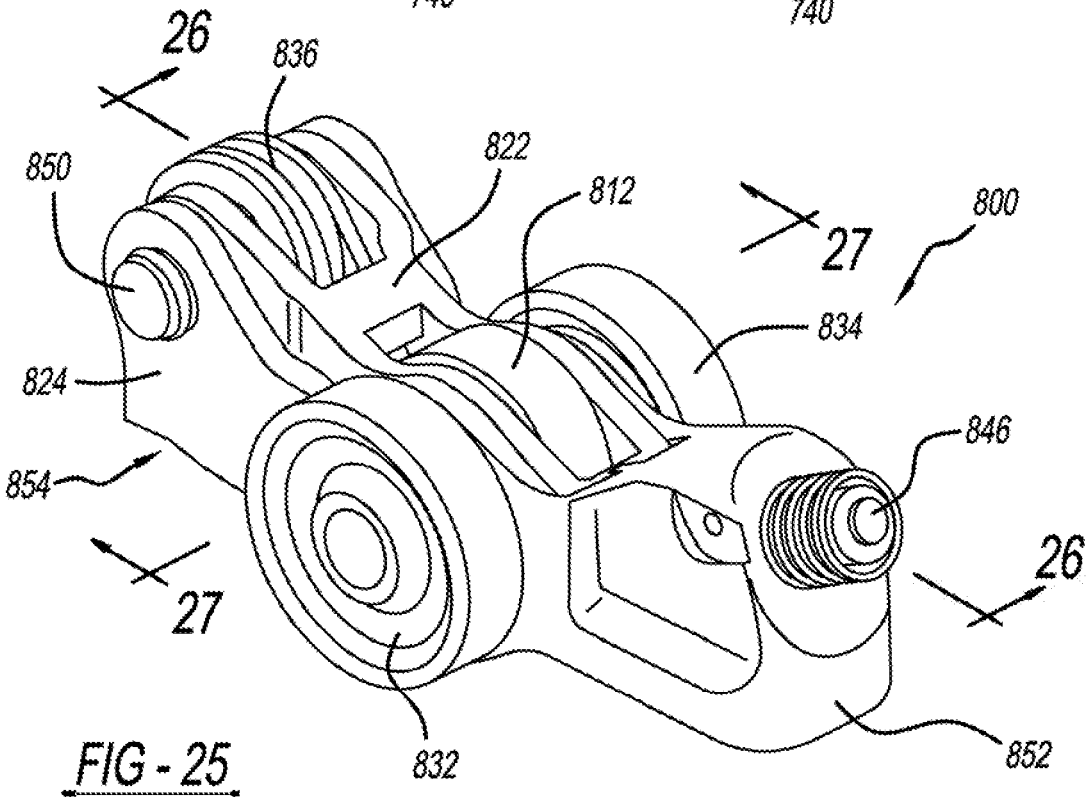
FIG. 25 is a perspective view of another three roller rocker arm according to other features.
Figure 26:
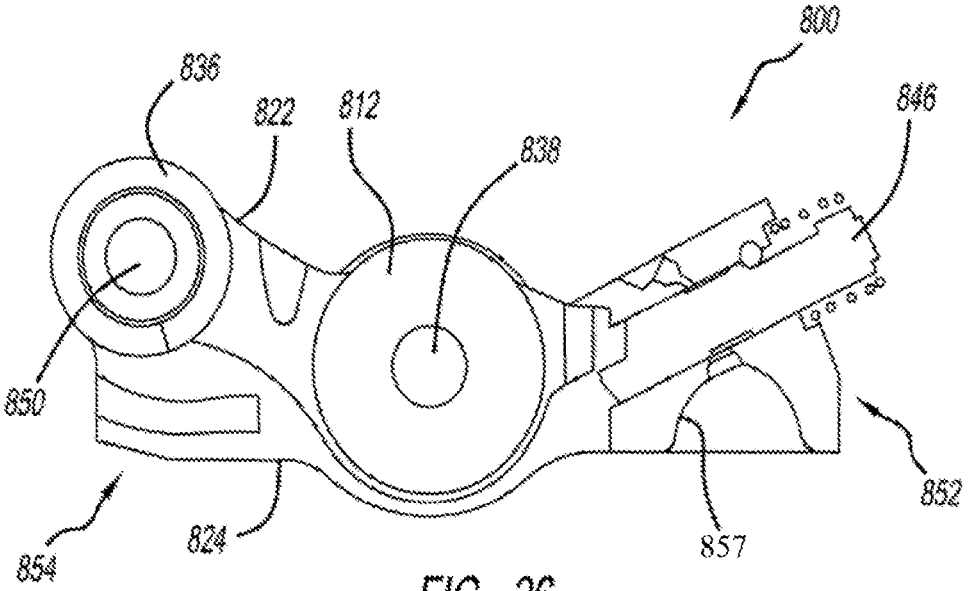
FIG. 26 is a cross-sectional view taken along lines 26-26 of FIG. 25.
Figure 27:
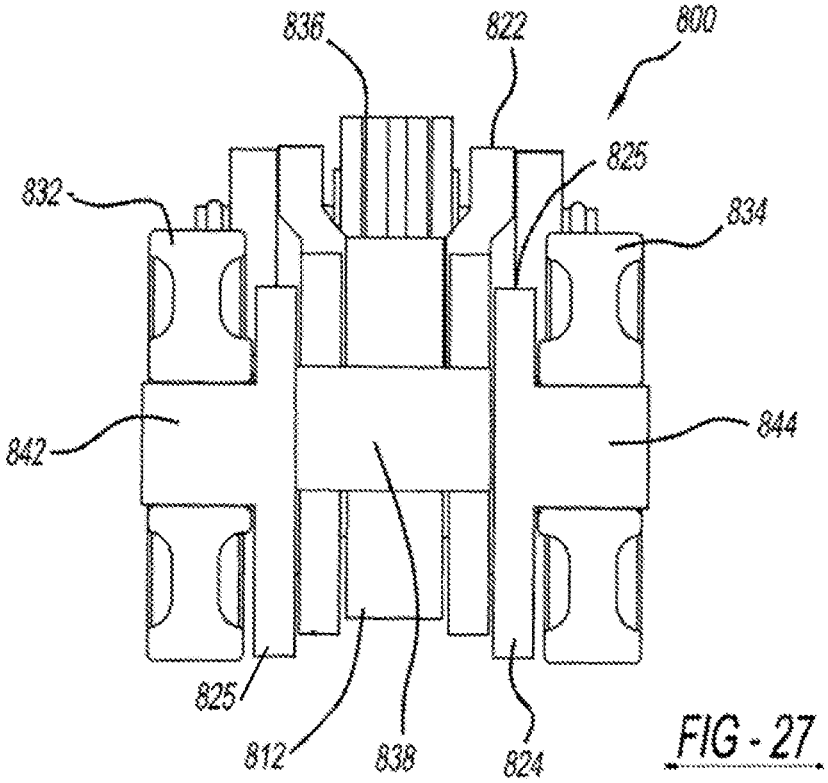
FIG. 27 is a cross-sectional view taken along lines 27-27 of FIG. 25

FIGS. 25-27 show a rocker arm 800 constructed in accordance to other features. The rocker arm 800 incorporates a three roller configuration including an inner roller 812 provided on an inner rocker arm 822 and outer rollers 832 and 834 arranged on the outer rocker arm 824. The outer arm 824 includes outer arm portions 825. The pivot axle 850 connects both the inner and outer arms 822, 824 and is placed over the top of the engine valve. A biasing member 836 is mounted between the inner and outer rocker arms 822 and 824. The inner roller 812 is mounted on an inner axle 838. The outer rollers 832 and 834 are mounted on outer axles 842 and 844. The outer axles 842 and 844 are integrally formed with the outer rocker arm 824. The outer rollers 832 and 834 are provided in a cantilevered arrangement relative to the outer rocker arm 824. The outer rollers 832 and 834 may be retained by snap rings or other means. A latch 846 moves between a latched position where the inner and outer rocker arms 822 and 824 are fixed for concurrent rotation and an unlatched position where the inner and outer rocker arms 822 and 824 can rotate relative to each other. The latch 846 is shown in an unlatched position in FIG. 26. The three roller configuration enables variable valve lift with high lost motion. An inner axle 838 is mounted to the inner arm 822. The inner axle 838 is seated between outer arm portions 825 of the outer rocker arm 824. The inner roller 812 is mounted on the inner axle 838. The integrally formed axles 842, 844 are positioned on either side of the inner axle 838. The integrated axle configuration shown in FIGS. 24-27 may also be provided on the outer rocker arms for the other examples herein for mounting outer rollers in a three-roller configuration.

The outer rocker arm 824 is mounted over the hydraulic lash adjuster and interfaces with a ball socket area 857 of the lash adjuster in a tangential contact. The socket area 857 is proximal to the latch pin 846. The latch pin 846 is positioned at the rear side of the outer rocker arm 824 extending inward, toward the inner rocker arm 822 for latching. The inner and outer rocker arms 822, 824 are arranged to pivot about a pivot axle 850 on the valve end 854 wherein the latch 846 is aligned on the HLA end 852. The valve end 854 is on a first side of the inner axle 838 and the latch 846 is on a second side of the inner axle 838.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A switching rocker arm comprising:

a one-piece outer arm including:

a front end arranged at a valve end of the switching rocker arm, a rear end arranged at a hydraulic lash adjuster (HLA) end of the switching rocker arm, the rear end configured to interface with a HLA, and a pair of outer arm portions extending from the front end to the rear end, each outer arm portion comprising an integrally formed cantilevered post extending laterally outward from a middle portion of the outer arm, each cantilevered post serving as an outer axle;

an inner arm including a front end seated within the front end of the outer arm;

an inner axle mounted to the inner arm between the pair of the outer arm portions;

an inner roller rotatably mounted on the inner axle;

a pair of outer rollers rotatably mounted on the outer axles, respectively;

a pivot axle arranged at the valve end of the switching rocker arm, the pivot axle pivotably connecting the front end of the inner arm to the front end of the outer arm; and a latch arranged at the HLA end of the switching rocker arm in proximity to the HLA, the latch configured to selectively extend inward toward a rear end of the inner arm, wherein the latch is configured to switch between a latched position in which the inner arm is coupled to the outer arm so as to rotate concurrently, and an unlatched position in which the inner arm is decoupled from the outer arm so as to rotate relative to each other.

2. The switching rocker arm of claim 1, wherein the pair of outer rollers are cantilevered relative to the outer arm.

3. The switching rocker arm of claim 1, further comprising:

a pair of snap rings configured to retain the pair of outer rollers on the outer axles, respectively.

4. The switching rocker arm of claim 1, further comprising:

a pair of stopper bushings configured to retain the pair of outer rollers on the outer axles, respectively.

5. The switching rocker arm of claim 1, wherein, when the latch is in the latched position, the latch is extended so as to engage the inner arm.

6. The switching rocker arm of claim 1, wherein when the latch is in the unlatched position, the latch is retracted from the inner arm.

7. The switching rocker arm of claim 1, further comprising:

a biasing member mounted on the pivot axle between two front portions of the front end of the inner arm.

8. The switching rocker arm of claim 1, further comprising a pair of biasing members arranged between the inner arm and the pair of outer arm portions, respectively, at a position away from the valve end of the switching rocker arm.

9. The switching rocker arm as described in claim 8, wherein the pair of biasing members are configured to bias the inner arm to a predetermined position relative to the outer arm.

10. The switching rocker arm of claim 8, wherein the pair of biasing members are mounted to the inner arm at a position proximal to the latch.

11. The switching rocker arm of claim 8, wherein the pair of biasing members are mounted to the outer arm on the HLA end of the switching rocker arm.

12. The switching rocker arm of claim 1, wherein the outer axles extend coaxially relative to the inner axle.

13. The switching rocker arm of claim 1, wherein the HLA end of the switching rocker arm includes a socket area configured to receive the HLA.

14. The switching rocker arm of claim 13, wherein the latch is proximal to the socket area at the HLA end of the switching rocker arm.

15. The switching rocker arm as described in claim 1, wherein the outer arm further includes:

a connecting arm configured to connect the pair of outer arm portions to each other.

16. The switching rocker arm of claim 15, wherein the valve end of the switching rocker arm is configured to engage an engine valve.

* * * * *